US010665053B2

(12) United States Patent
Chesworth et al.

(10) Patent No.: US 10,665,053 B2
(45) Date of Patent: May 26, 2020

(54) CONFIGURING GAMING SYSTEM OPTIONS BASED ON PLAYER SKILL

(71) Applicant: BALLY GAMING, INC., Las Vegas, NV (US)

(72) Inventors: Jack F. Chesworth, Hurlstone Park (AU); Ross M. Gilbertson, Ultimo (AU); Arthur Rotziokos, Marrickville (AU); Terence C. Tse, Carlingford (AU); Peter R. Wilkins, Curl Curl (AU); Qin You, Randwick (AU)

(73) Assignee: SG Gaming, Inc., Las Negas, NV (US)

( * ) Notice: Subject to any disclaimer, the term of this patent is extended or adjusted under 35 U.S.C. 154(b) by 209 days.

(21) Appl. No.: 15/040,408

(22) Filed: Feb. 10, 2016

(65) Prior Publication Data

US 2017/0228976 A1 Aug. 10, 2017

(51) Int. Cl.
*G07F 17/32* (2006.01)
*G07F 17/34* (2006.01)

(52) U.S. Cl.
CPC ..... *G07F 17/3227* (2013.01); *G07F 17/3213* (2013.01); *G07F 17/3244* (2013.01); *G07F 17/3255* (2013.01); *G07F 17/3262* (2013.01); *G07F 17/3267* (2013.01); *G07F 17/3288* (2013.01); *G07F 17/3295* (2013.01); *G07F 17/34* (2013.01)

(58) Field of Classification Search
CPC .. G07F 17/32; G07F 17/3244; G07F 17/3255; G07F 17/3262; G07F 17/3267
USPC ..... 463/16, 20, 21, 23
See application file for complete search history.

(56) References Cited

U.S. PATENT DOCUMENTS 6,050,895 A 4/2000 Luciano, Jr. et al. ..... G07F 17/3295
6,267,669 B1 7/2001 Luciano, Jr. et al. ..... G07F 17/3244
6,435,511 B1 8/2002 Vancura et al. .... G07F 17/3244
6,554,283 B2 4/2003 Vancura et al. .... G07F 17/3244
6,692,005 B2 2/2004 Vancura et al. .... G07F 17/3244
6,761,632 B2 7/2004 Bansemer et al. ..... G07F 17/3295
6,780,103 B2 8/2004 Bansemer et al. ..... G07F 17/3295
6,837,793 B2 1/2005 McClintic ..... G07F 17/32
6,942,568 B2 9/2005 Baerlocher ..... G07F 17/3244
6,984,174 B2 1/2006 Cannon et al. ..... G07F 17/32
7,056,210 B2 6/2006 Bansemer et al. ..... G07F 17/3295
7,175,524 B2 2/2007 Bansemer et al. ..... G07F 17/3295
7,360,764 B2 4/2008 Vancura et al. .... G07F 17/3244
(Continued)

*Primary Examiner* — Chase E Leichliter
(74) *Attorney, Agent, or Firm* — Grant A. Dingledine

(57) ABSTRACT

A regulated gaming system includes game-logic circuitry, an electronic display device, and an electronic input device detecting a physical item associated with a monetary value to establish a credit balance. The gaming system performs a casino wagering game initiated by an input indicative of a wager covered by the credit balance. The casino wagering game comprises a base-game feature and a bonus-game feature having a skill-based feature and a non-skill-based feature. When the bonus-game feature is triggered, a player participates in the skill-based feature and a set of configuration options is determined in response to input selections made by the player. The non-skill-based feature of the wagering game is customized using the determined set of configuration options. A resultant wagering game outcome is determined from the base-game feature and the bonus-game feature, and a credit balance is adjusting accordingly, prior to a cashout of the credit balance.

16 Claims, 16 Drawing Sheets

(56) References Cited

U.S. PATENT DOCUMENTS 7,556,267 B2 7/2009 Vancura et al. .... G07F 17/3244
7,722,461 B2 5/2010 Gatto et al. ..... G07F 17/32
7,789,749 B2 9/2010 Bansemer et al. ..... G07F 17/3295
7,846,015 B2 12/2010 Bansemer et al. ..... G07F 17/3295
8,033,912 B2 10/2011 Cannon ..... G07F 17/3244
8,075,391 B2 12/2011 Rommerdahl et al. ..... G07F 17/3244
8,157,645 B1 4/2012 Kelly ..... G07F 17/3225
8,162,742 B2 4/2012 Oberberger ..... G07F 17/3295
8,177,621 B2 5/2012 Jaffe et al. ..... G07F 17/3244
8,231,453 B2 7/2012 Wolf et al. ..... G07F 17/3295
8,240,670 B2 8/2012 Vancura et al. .... G07F 17/3244
8,251,799 B2 8/2012 Rommerdahl et al. ..... G07F 17/3244
8,282,489 B2 10/2012 Arezina et al. ..... A63F 9/24
8,308,556 B2 11/2012 Thomas ..... G07F 17/3295
8,337,300 B2 12/2012 Bowers et al. ..... G07F 17/3244
8,348,736 B2 1/2013 Mitelman ..... A63F 9/24
8,398,475 B2 3/2013 De Waal et al. ..... G07F 17/34
8,430,407 B2 4/2013 Vancura et al. .... G07F 17/3244
8,435,111 B2 5/2013 Filipour et al. ..... G07F 17/3295
8,475,262 B2 7/2013 Wolf et al. ..... G07F 17/3295
8,475,263 B2 7/2013 Arnone et al. ..... G07F 17/3244
8,475,266 B2 7/2013 Rommerdahl et al. ..... G07F 17/3244
8,528,908 B2 9/2013 Vancura et al. .... G07F 17/3244
8,562,445 B2 10/2013 Arnone et al. ..... G07F 17/3225
8,585,489 B2 11/2013 Cannon ..... G07F 17/3244
8,602,881 B2 12/2013 Arnone et al. ..... G07F 17/3227
8,628,408 B2 1/2014 Popovich et al. .. G07F 17/3262
8,632,395 B2 1/2014 Arnone et al. ..... G07F 17/3244
8,636,577 B2 1/2014 Arnone et al. ..... G07F 17/3225
8,657,660 B2 2/2014 Meyerhofer et al. ..... G07F 17/326
8,657,675 B1 2/2014 Arnone et al. ..... G07F 17/3258
8,668,581 B2 3/2014 Arnone et al. ..... G07F 17/32
8,672,748 B2 3/2014 Arnone et al. ..... G07F 17/3244
8,684,813 B2 4/2014 Arnone et al. ..... G07F 17/329
8,684,829 B2 4/2014 Arnone et al. ..... G07F 17/3288
8,708,808 B2 4/2014 Arnone et al. ..... G07F 17/3225
8,715,068 B2 5/2014 Arnone et al. ..... G07F 17/3244
8,715,069 B2 5/2014 Arnone et al. ..... G07F 17/3279
8,715,085 B2 5/2014 Crowder, Jr. et al. ..... G07F 17/3244
8,734,232 B2 5/2014 Arnone et al. ..... G07F 17/3244
8,734,238 B2 5/2014 Bunch et al. ..... G07F 17/3241
8,740,690 B2 6/2014 Arnone et al. ..... G07F 17/34
8,747,227 B2 * 6/2014 Steene ..... G07F 17/32 463/13
8,753,193 B2 6/2014 Arnone et al. ..... G07F 17/3262
8,753,212 B2 6/2014 Popovich et al. .. G07F 17/3225
8,758,122 B2 6/2014 Arnone et al. ..... G07F 17/3227
8,764,552 B2 7/2014 Wolf et al. ..... G07F 17/3295
8,770,585 B2 7/2014 Vancura et al. .... G07F 17/3244
8,771,082 B2 7/2014 Arezina et al. ..... G07F 17/3244
8,790,170 B2 7/2014 Arnone et al. ..... G07F 17/3244
8,808,086 B2 8/2014 Arnone et al. ..... G07F 17/3267
8,814,666 B2 8/2014 Luciano, Jr. et al. ..... G07F 17/3244
8,821,264 B2 9/2014 Arnone et al. ..... G07F 17/3244
8,821,270 B2 9/2014 Arnone et al. ..... G07F 17/32
8,827,787 B2 9/2014 Smith et al. ..... G07F 17/3295
8,834,263 B2 9/2014 Arnone et al. ..... G07F 17/32
8,845,408 B2 9/2014 Meyerhofer et al. ..... G07F 17/3225
8,845,419 B2 9/2014 Arnone et al. ..... G07F 17/3258
8,845,420 B2 9/2014 Arnone et al. ..... G07F 17/3227
8,851,967 B2 10/2014 Arnone et al. ..... G07F 17/326
8,858,321 B2 10/2014 Popovich et al. .. G07F 17/3262
8,882,586 B2 11/2014 Arnone et al. ..... G07F 17/3244
8,905,840 B2 12/2014 Arnone et al. ..... G07F 17/3225
8,926,423 B2 1/2015 Filipour et al. ..... G07F 17/3295
8,944,899 B2 2/2015 Arnone et al. ..... G07F 17/3244
8,951,109 B2 2/2015 Arnone et al. ..... G07F 17/34
8,951,113 B2 2/2015 Arnone et al. ..... G07F 17/3267
8,974,294 B2 3/2015 Arnone et al. ..... G07F 17/3225
8,986,097 B2 3/2015 Arnone et al. ..... G07F 17/329
8,986,110 B2 3/2015 Arnone et al. ..... G07F 17/3241
8,986,117 B2 3/2015 Arnone et al. ..... G07F 17/32
8,992,297 B2 3/2015 De Waal et al. ..... G07F 17/34
8,998,707 B2 4/2015 Arnone et al. ..... G07F 17/326
9,005,008 B2 4/2015 Baerlocher ..... G07F 17/3288
9,005,014 B2 4/2015 Arnone et al. ..... A63F 9/24
9,039,508 B1 5/2015 Arnone et al. ..... G07F 17/3227
9,039,521 B2 5/2015 Arnone et al. ..... G07F 17/3227
9,039,536 B2 5/2015 Arnone et al. ..... G07F 17/3225
9,047,735 B2 6/2015 Arnone et al. ..... G07F 17/3244
9,058,723 B2 6/2015 Arnone et al. ..... G07F 17/3262
9,092,933 B2 7/2015 Arnone et al. ..... G07F 17/3225
9,095,773 B2 8/2015 Mitelman ..... A63F 9/24
9,135,776 B2 9/2015 Arnone et al. ..... G07F 17/3227
9,177,435 B2 11/2015 Arnone et al. ..... G07F 17/32
9,682,311 B2 * 6/2017 Gilliland ..... A63F 13/00
2002/0160825 A1 * 10/2002 Nicastro ..... G07F 17/32 463/16
2006/0025201 A1 * 2/2006 Van Asdale ..... G07F 17/32 463/20
2009/0061997 A1 * 3/2009 Popovich ..... G07F 17/32 463/26
2009/0280891 A1 * 11/2009 Filipour ..... G07F 17/32 463/22
2011/0039621 A1 * 2/2011 Steene ..... G07F 17/32 463/42
2011/0212766 A1 * 9/2011 Bowers ..... G07F 17/32 463/25
2012/0115580 A1 * 5/2012 Hornik ..... G07F 17/3258 463/25
2012/0115581 A1 * 5/2012 Englman ..... G07F 17/3258 463/25
2014/0087808 A1 3/2014 Basallo et al. ..... G07F 17/3262
2014/0087844 A1 * 3/2014 Gilliland ..... A63F 13/00 463/25
2014/0087855 A1 * 3/2014 Caputo ..... G07F 17/3258 463/26
2014/0302898 A1 10/2014 Vann ..... G07F 17/326
2014/0309002 A1 * 10/2014 O'Gorman ..... G07F 17/3267 463/7
2015/0018072 A1 1/2015 Palchetti et al. ..... G07F 17/326
2015/0094135 A1 4/2015 Hedrick et al. ..... A63F 13/792
2015/0119127 A1 * 4/2015 Arnone ..... G07F 17/326 463/17
2015/0262450 A1 * 9/2015 Elias ..... G07F 17/3262 463/25
2015/0287264 A1 * 10/2015 De Viveiros Ortiz ..... G07F 17/3244 463/25
2016/0098896 A1 * 4/2016 Arnone ..... G07F 17/3244 463/25
2017/0024970 A1 * 1/2017 Sherrets ..... G07F 17/3244

* cited by examiner

CONFIGURING GAMING SYSTEM OPTIONS BASED ON PLAYER SKILL

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to determining options and features available for customizing a gaming system based on player skill.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

The implementation of skill-based features adds another level of complexity and flexibility to gaming. As a result of the skill-based game, more skilled performances may relate to higher payouts. For example, skill-based features provided in wagering games may be used to directly alter the payback percentage of the wagering game (a.k.a. return-to-player (RTP), theoretical expected value (EV), etc.). Thus, a skilled player performance during the skill-based feature may result in a modified payback of the wagering game, altered in favor of the player. Payback of the wagering game may be likewise modified by awarding a fixed credit prize at the end of the skill-based feature commensurate with the skill or performance of the player. Alternatively, a payback of the wagering game may be modified by increasing either the number of spins or the win multiplier within a free game feature. Thus, skill-based gaming benefits players by offering higher rewards for higher skilled performance and benefits operators by increasing revenue while players attempt to increase skill while enjoying more diverse and exciting wagering game features.

SUMMARY OF THE INVENTION

According to one aspect of the present invention, a gaming system is described comprising a regulated gaming machine and game-logic circuitry. The gaming system may be incorporated into a single, freestanding gaming machine. The gaming machine includes an electronic display device and one or more electronic input devices and is primarily dedicated to playing at least one casino wagering game. The casino wagering game is configured having a skill-based feature and a non-skill-based feature. The game-logic circuitry is configured to detect a physical item associated with a monetary value that establishes a credit balance by at least one of the one or more electronic input devices. In response to an initiation input indicative of a wager covered by the credit balance, the casino wagering game is initiated. A player-selected configuration option for the non-skill-based feature of the casino wagering game is designated based upon a skill-based input from a player during the skill-based feature. An outcome for the casino wagering game is determined in accordance with the player-selected configuration option applied to events during the non-skill-based feature, the outcome is displayed via the electronic display device, and the credit balance is adjusted in accordance with the outcome. A cashout input is received by at least one of the one or more electronic input devices, initiating a payout from the credit balance.

According to another aspect of the invention, a computer-implemented method in a gaming system is described. The gaming system includes game-logic circuitry and a regulated gaming machine. The gaming machine includes an electronic display device and one or more electronic input devices and is primarily dedicated to playing at least one casino wagering game. The casino wagering game includes a skill-based feature and a non-skill-based feature. The computer-implemented method includes detecting a physical item associated with a monetary value that establishes a credit balance by at least one of the one or more electronic input devices. The skill-based feature of the casino wagering game is initiated in response to an input indicative of a wager covered by the credit balance by the game-logic circuitry. A plurality of player-selectable configuration options are determined by the game-logic circuitry for the non-skill-based feature of the casino wagering game based upon a skill-based input from a player during the skill-based feature. A selection of one or more of the player-selectable configuration options is detected via at least one of the one or more electronic input devices. An outcome for the casino wagering game is determined by the game-logic circuitry in accordance with the selected configuration options applied to events during the non-skill-based feature, the outcome is displayed via the electronic display device, and the credit balance is adjusted in accordance with the outcome. A cashout input is received by the game-logic circuitry, initiating a payout according to the credit balance.

According to another aspect of the invention, a computer-implemented method in a gaming system is described. The gaming system comprises game-logic circuitry and a regulated gaming machine. The gaming machine includes an electronic display device and one or more electronic input devices and is primarily dedicated to playing at least one casino wagering game. The casino wagering game is configured having a skill-based feature and a non-skill-based feature. The computer-implemented method includes detecting a physical item associated with a monetary value that establishes a credit balance via at least one of the one or more electronic input devices. The casino wagering game is initiated in response to an initiation input indicative of a wager covered by the credit balance via the game-logic circuitry. A player-selected configuration option is designated for the non-skill-based feature of the casino wagering game via the game-logic circuitry, based upon a skill-based input from a player during the skill-based feature. An outcome is determined for the casino wagering game by the game-logic circuitry in accordance with the player-selected configuration option applied to events during the non-skill-based feature, an outcome is displayed via the electronic display device, and the credit balance is accordingly adjusted in accordance with the outcome. A cashout input is received by at least one of the one or more electronic input devices, initiating a payout from the credit balance.

Additional aspects of the invention will be apparent to those of ordinary skill in the art in view of the detailed description of various embodiments, which is made with reference to the drawings, a brief description of which is provided below.

Figure 1:
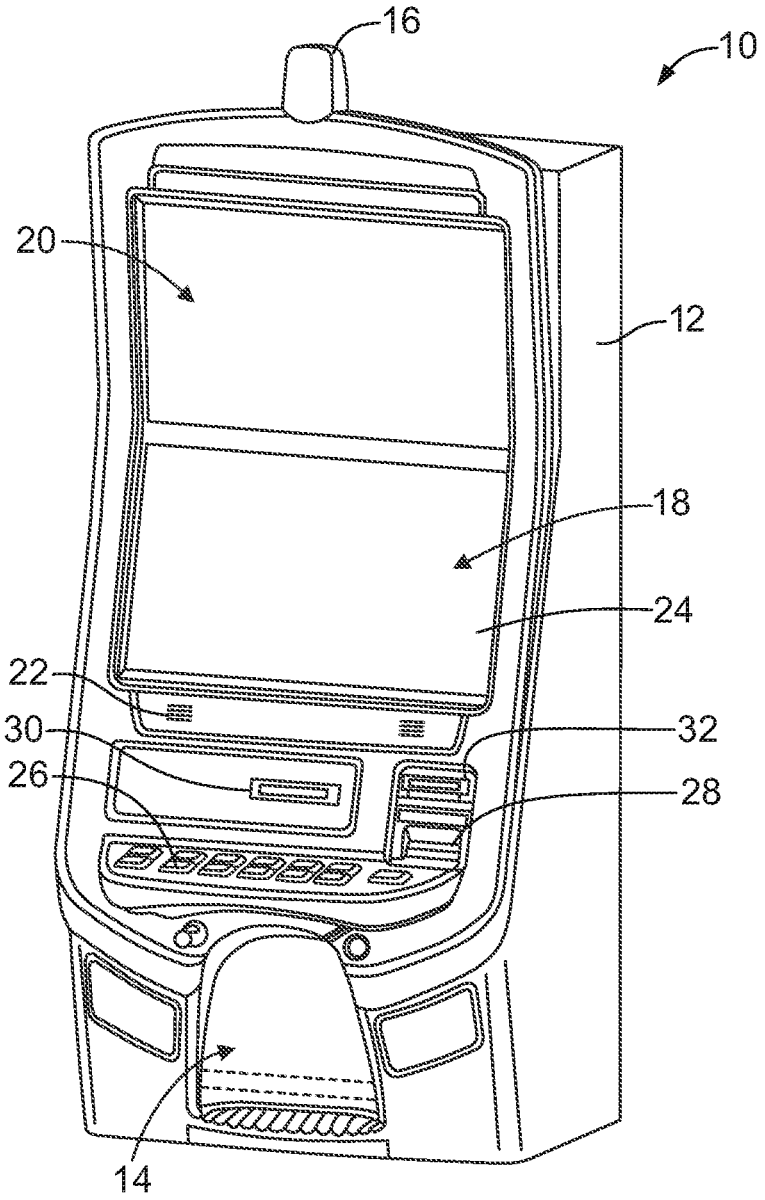
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
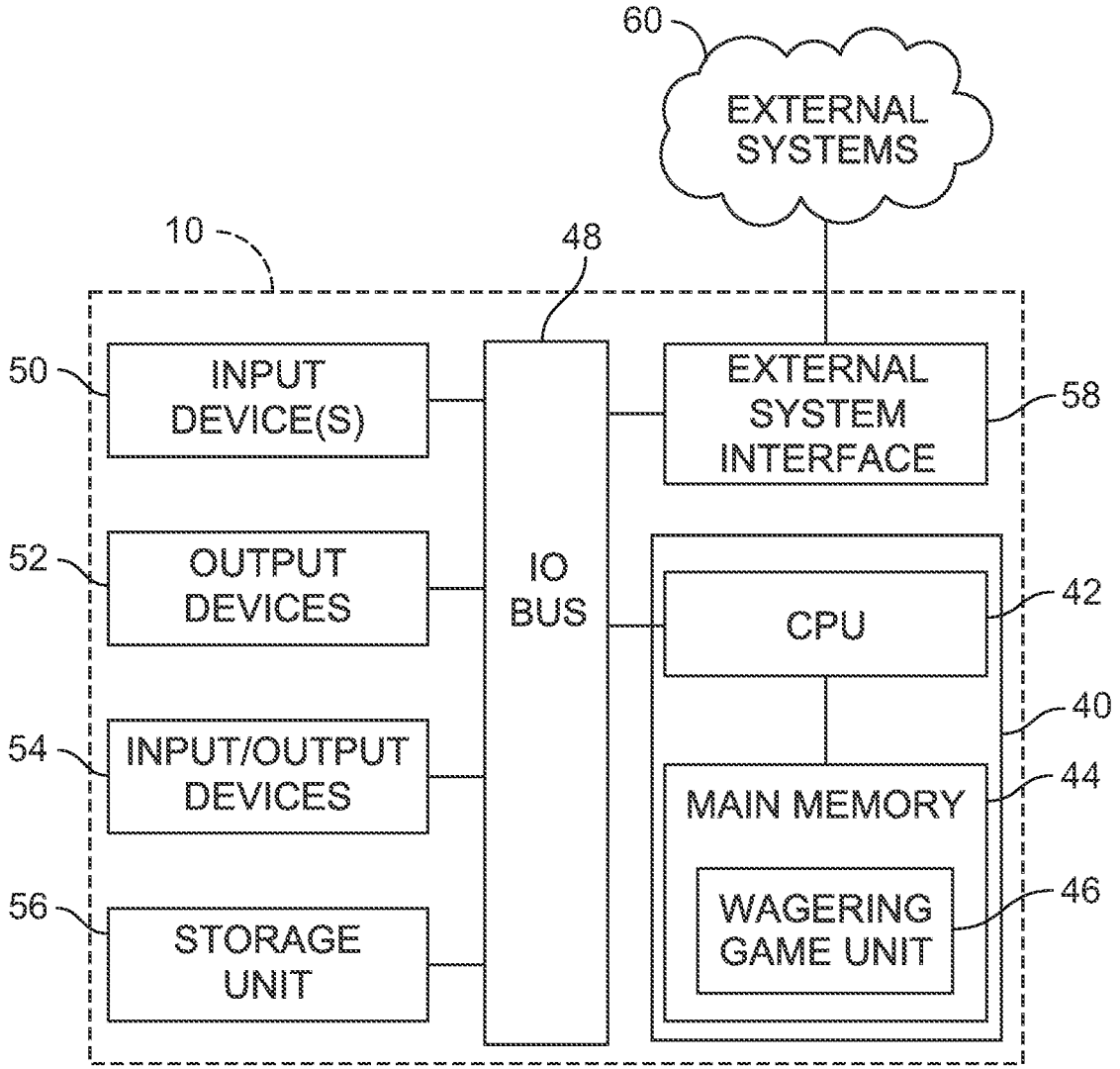
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The input devices 50 and input/output devices 54 may also include devices that enable the use of hardware to achieve direct interaction with the gaming machine 10 and any wagering game performed thereby. For example, various hardware components may enable the activation and utilization of gesture-based input (e.g., motion detector), voice recognition, sound and image based input (e.g., camera(s) and microphone(s)), tactile input (e.g., trackball, touchpad, etc.), and various other input means to provide a player a choice of different inputs to use when interacting with the gaming machine 10. For example, a gaming machine 10 may provide a player to have an option for input that includes gesture-based input, voice issued commands, or actuated button commands, among others.

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
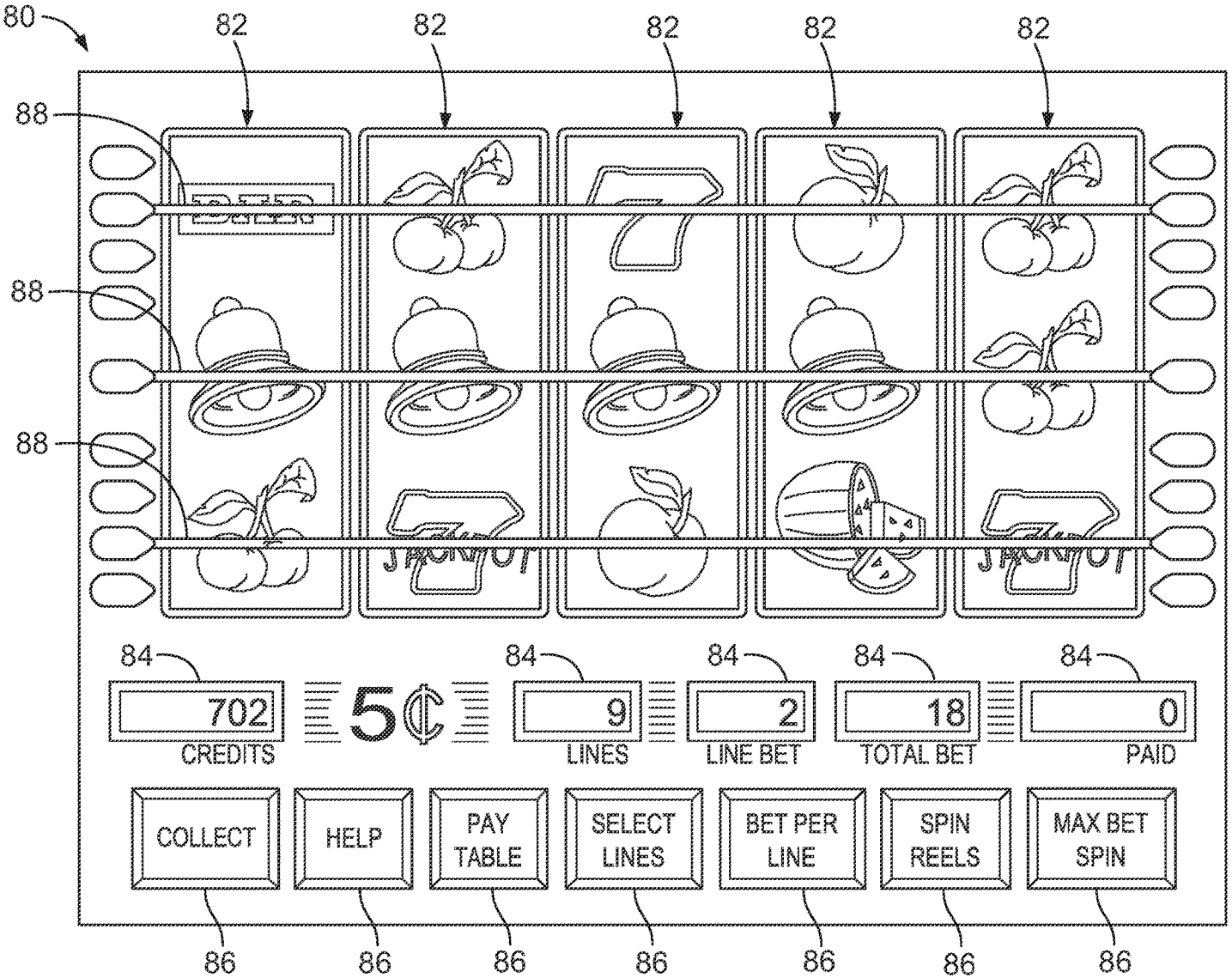
FIG. 3 is an image of an exemplary basic-game visual interface of a wagering game displayed on a screen of a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

In one embodiment, the present invention relates to determining a range of available and selectable customizing configuration options or features that are presented to a player during a wagering game. The variety of options for customization may be based wholly or partially upon the level of skill and/or skill-based performance of the player. A configuration option may have any number of parameters and/or attributes that are used to customize and configure wagering game features. A skill-based feature may be used to customize the wagering game, or a segment thereof (e.g., a free game feature), by expressly specifying what configuration option (i.e., parameters and attributes) are used for customization. In one embodiment, after the wagering game is initiated and before an outcome for the wagering game is determined, a skill-based feature is conducted and played by the player wherein the player is given the ability to choose one or more options for one or more non-skill-based features of the wagering game based on the player performance during the skill-based feature. In another embodiment, after the wagering game is initiated and before an outcome for the wagering game is determined, a skill-based feature is conducted and skill-based player input is used to directly choose a configuration option (having corresponding parameters) for one or more non-skill-based features of the wagering game.

Various types of skill may be employed during a skill-based feature for determining player skill level and/or determining a range of configuration options that are available or assigned to customize one or more wagering game instances. For example, different types of skill that could be employed in a skill-based feature may include dexterity (e.g., shooting games, twitch gameplay, skill-stop games, etc.), memory (e.g., pick-n-match or sequence duplication games, "Concentration", "Simon", etc.), strategy (e.g., puzzle solving games, "Sudoku", "Minesweeper", etc.), trivia (knowledge-based games, "Trivial Pursuit", "Ripley's Believe It or Not", etc.), along with a multitude of others, and any and all combinations thereof.

The ability for enabling a player to personalize or customize a wagering game without fundamentally changing the operation or payback percentage of the wagering game is also advantageous. Giving the player more choices, even while ultimately maintaining critical aspects of the wagering game unchanged, helps to better engage the player in the gaming experience and provide memorable and enjoyable interactions. Further, the player is more likely to play a wagering game that includes gaming features or designs that are preferred than other wagering games that have non-preferred or undesirable attributes. Thus, the ability to customize gaming experiences for a particular player, while maintaining or manipulating the RTP and overall operation of the wagering game, is desirable for an owner-operator for at least reasons that include no revenue generation is sacrificed while players are enjoying personally customized gaming experiences.

Various types of configuration options (e.g., grouped sets of gaming parameters) may be employed to modify, customize, or personalize wagering games and constituent events and features based on a determined skill of a player. While skill-based features may be used to directly modify the overall payback percentage of a wagering game (e.g., return-to-player (RTP), theoretical expected value (EV), etc.), other aspects of the wagering game may also be modified (or provided within specific ranges) without affecting or adversely impacting the payback percentage of the wagering game. Some examples include modification of game volatility (e.g., number and frequency of payouts, payout potential, etc.), modification of the number, sequence, and/or type of symbols on one or more symbol-based reels, customization of game themes or genres (e.g., contemporary, mythical, cultural, etc.), available game types (e.g., multi-games, duplicate games, etc.), game or feature eligibility (e.g., restricted game themes, progressive jackpots, community-based games, etc.), game/time availability/eligibility reservations (e.g., ability to gain exclusive or privileged usage), game denominations (e.g., one credit=one cent, two cents, five cents, one dollar, etc.), and/or betting options/levels (e.g., maximum number of paylines, maximum bet level amounts, available additional side-bets or ante-bets, etc.).

In one embodiment, the skill-based feature may reward the player by expanding a range of choices available when playing one or more features of the wagering game, including configuration options for non-skill-based features. The choices that the payer may select from may directly suit the player's preference, and may or may not impact the RTP of the wagering game. In some embodiments, each of the player-selected configuration options and associated parameters included therein have negligible or no effect on the overall RTP of the wagering game. The highest available RTP of a wagering game may be presumed to always be most desirable by the player and may be implemented automatically. In other embodiments, the skill-based feature (s) of a wagering game may modify the overall RTP of the wagering game or be limited to specific portions or features of the wagering game.

In some embodiments of the present invention, a skill-based feature portion of a wagering game does not provide a pecuniary incentive encouraging the player to spend additional money to improve determined skill or ability, or recover previously lost wagers. Instead, one or more skill-based features may provide a way for the player to earn points to make specific choices available for election. In one embodiment, points earned in a skill-based feature are accrued during the skill-based feature. These points are not spent or deducted in response to the player making a choice or selection for one or more portions of the wagering game, but instead, various sets of available configuration options (each having a distinct set of one or more parameters) become selectable by the player in accordance with the number of accrued points. Thus, a player gaining many points in the skill-based feature (exhibiting high skill) may have many more selectable options than a player gaining fewer points (exhibiting less skill). That is, the number of player-selectable options varies in size and amount. In one embodiment, a greater level of player-exhibited skill during the skill-based feature yields a greater number of player-selectable configuration options to choose from. In another embodiment, a greater level of player-exhibited skill during the skill-based feature yields a set of player-selectable configuration options having a greater variance in the volatility for a non-skill-based feature. In one example, a player may be given an opportunity to select one or more player-selectable configuration options, each player-selectable configuration option defining a volatility of one or more upcoming features of the wagering game. In one embodiment, the number and parameters of the available player-selectable configuration options may be determined in accordance with the number of earned points. In one example, each of the available player-selectable configuration options have a distinct combination of a number of free spins and a corresponding payout multiplier that are used to customize a non-skill-based feature having a series of free spins of symbol-bearing reels. Each of the available player-selectable configuration options specifies a particular volatility that is variant. Thus, a range of volatility choices are available for player selection, and a greater number of available player-selectable configuration options (i.e., a greater range of volatility choices for the non-skill-based feature) are presented to the player for selection in response to a greater level of skill exhibited during the skill-based feature.

Alternatively, a player may directly specify one or more customization parameters as part of a selected configuration option as a result of a skill-based feature. For example, consider a twitch-type skill-based feature of a wagering game where a player actively dodges asteroids to increase determined skill. In the feature, a payline multiplier for all bonus game wins is initialized at a given start value and increases steadily over time. A number of free spins is also initialized at a given start value and simultaneously decreases as the multiplier increases. The player must actively avoid asteroids in order to achieve a large multiplier (at a relatively low number of free spins). After a player impacts an asteroid, the skill-based feature ends and a set of bonus game free spins are conducted using the associated multiplier. In this scenario, a skilled player is essentially given a choice to achieve a greater multiplier or terminate the skill-based feature (by purposefully impacting an asteroid), selecting a current set of parameters defining a configuration option for a non-skill-based feature. That is, a skilled player gains the ability to effectively choose the volatility (i.e., the set of configuration parameter options used in the non-skill-based feature). However, this choice of parameters and configuration option (defining the volatility of the non-skill-based feature) is only available to a player sufficiently skilled as determined during the skill-based feature. In this embodiment, the skilled player effectively selects the parameters of the configuration option used in the non-skill-based feature, directly based on skill inputs performed during the skill-based feature.

In both these prior scenarios, the RTP of the wagering game is relatively unchanged regardless of the outcome of the skill-based feature. The number of options available to a player for selection expands in response to a higher determined skill of the player during the skill-based feature. In one embodiment, an increased skill of the player enables increased available options for other non-skill-based features of the wagering game.

Figure 4A:
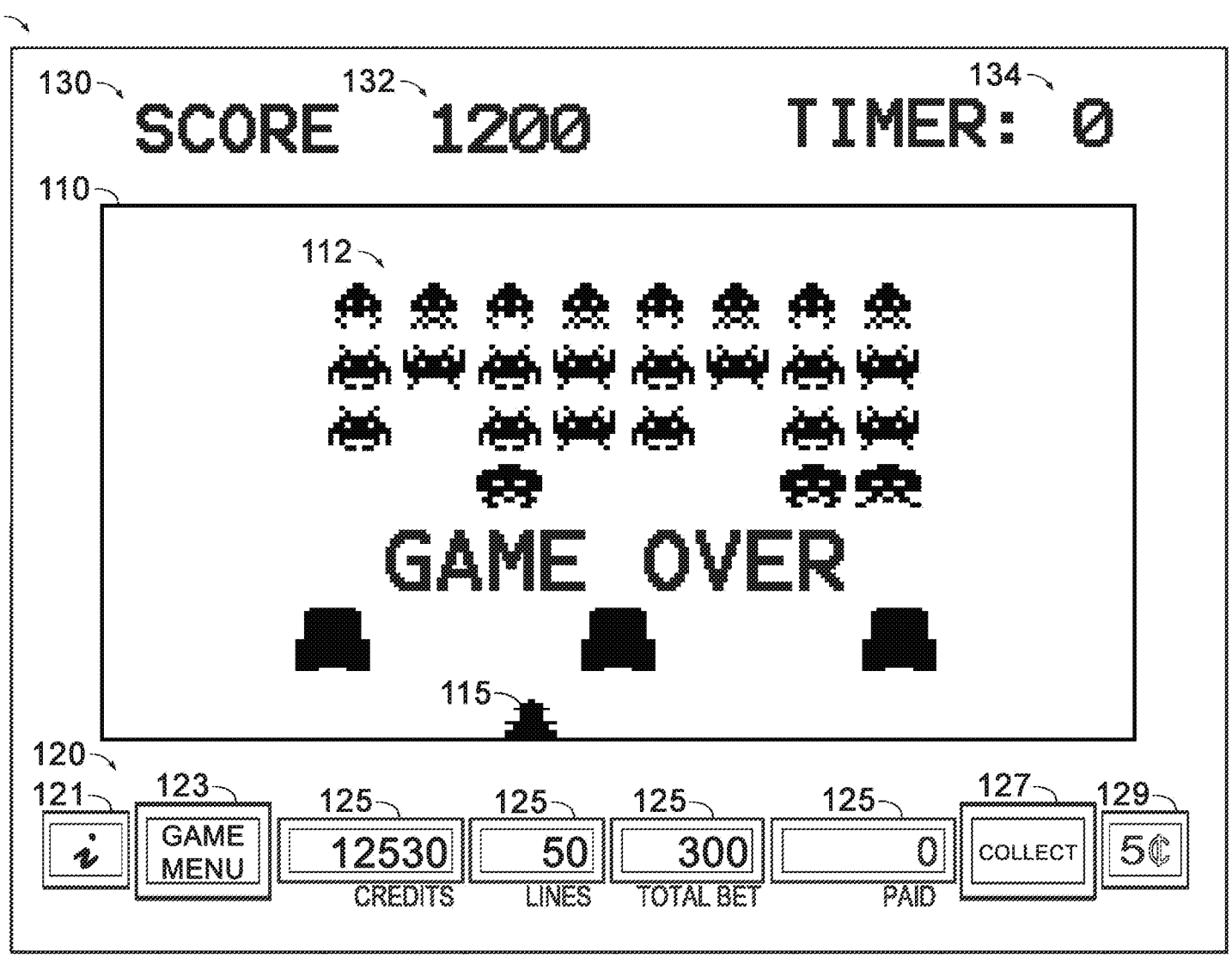
FIG. 4A is an image of an exemplary visual interface for a skill-based wagering game feature displayed on a screen of a gaming machine, according to an embodiment of the present invention.
Figure 4B:
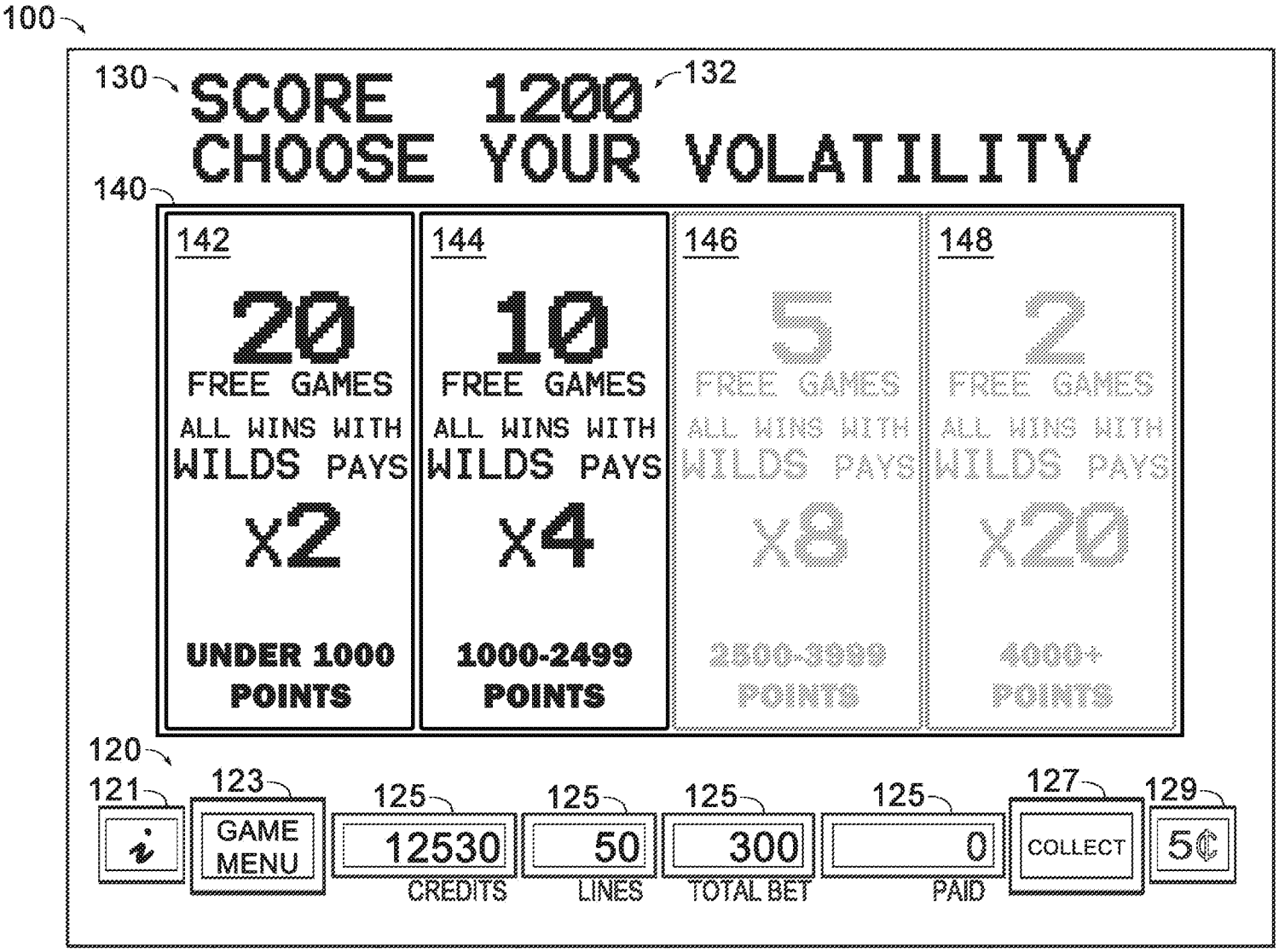
FIGS. 4B-4C are images of an exemplary visual interface for volatility selection for a non-skill-based wagering game feature displayed on a screen of a gaming machine, according to an embodiment of the present invention.
Figure 4C:
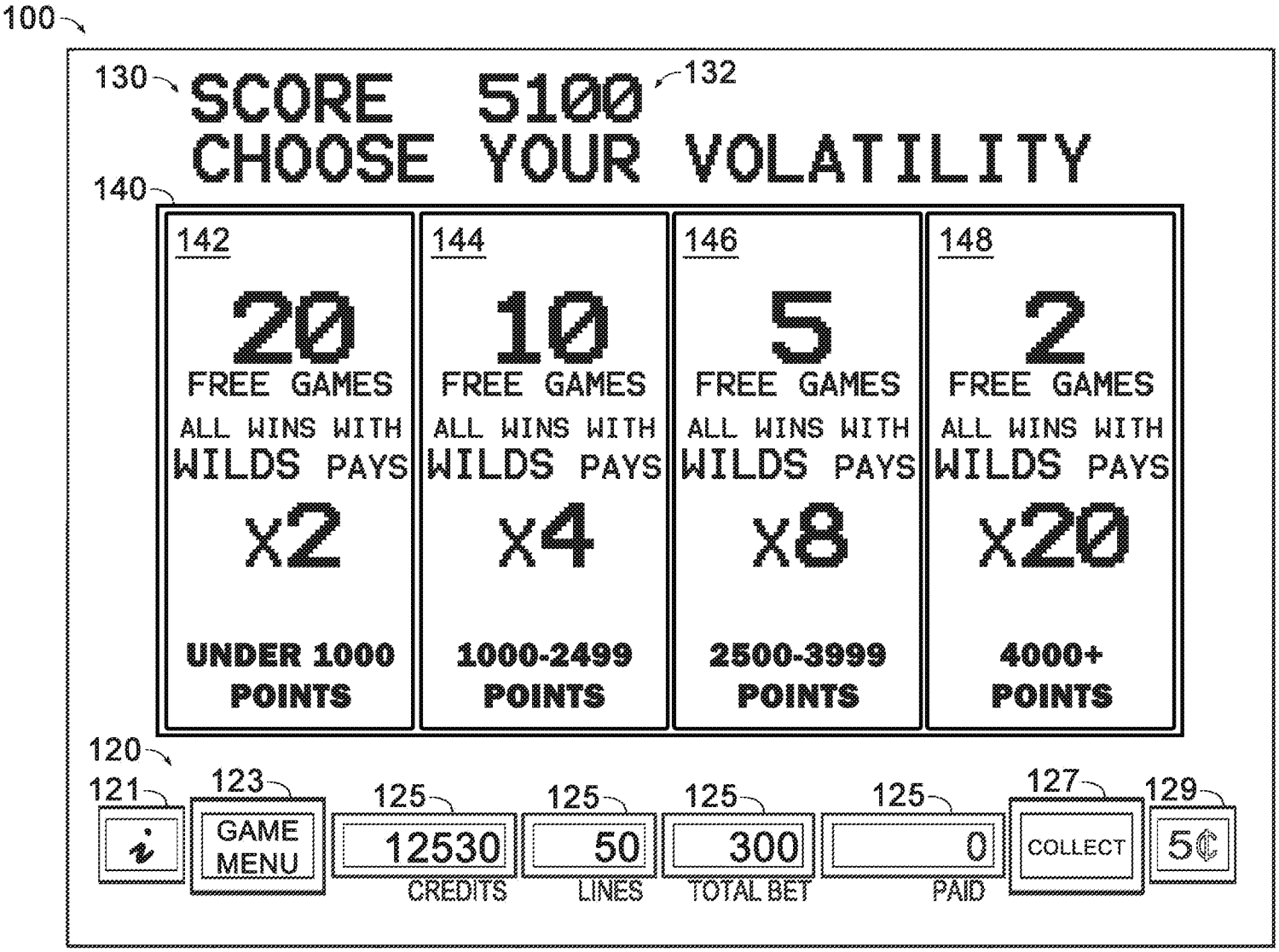

Referring now to FIGS. 4A-4C, an embodiment having an interface 100 exhibits how a range of choices for a non-skill-based feature of a wagering game may be expanded based on the player performance during a skill-based feature of a wagering game. In this embodiment, when a skill-based game feature is triggered, the player initially enters a skill-based game such as Space Invaders®. Alternatively, another skill-based feature with the provision for earning or scoring points is suitable for a similar determination of skill for a player using received skill-based input. In some embodiments, the skill-based input is used to determine a quantitative measure of skill for the player based upon a tallied score during the skill-based feature. In other embodiments, a more qualitative approach may be used to determine an exhibited level of skill of the player during the skill-based feature.

In one embodiment, as shown in FIG. 4A, an interface 100 is displayed to the player when the skill-based feature begins. The interface 100 includes a gaming section 110, a lower banner 120, and an upper banner 130. The gaming section 110 includes a wave of alien ships 112 and a cannon platform 115 at the bottom of the gaming section 110. The wave of alien ships 112 move horizontally until reaching an edge of the gaming section 110, and then descend toward the cannon platform 115. The lower banner 120 includes a series of buttons and meters that reflect various aspects of the wagering game as whole and may or may not display details regarding the feature currently being conducted. In one embodiment, banner 120 includes an information button 121, a menu button 123, meters 125, collect button 127, and a denomination marker 129. The upper banner 130 includes a score meter 132 and a timer meter 134. While the interface 100 is shown having a particular structure, the interface 100 may omit one or more interface components as shown, include various other interface components (not currently shown), and/or include interface components and sub-components in any combination.

In one embodiment, the player uses one or more input devices (e.g., input devices 50) to provide skill-based input to control the cannon platform 115 in an attempt to destroy the approaching wave of alien ships 112 before any of the alien ships reach the bottom of the screen. The player must also avoid being destroyed by shots fired from the alien ships to continue the feature. The player controls the cannon platform 115 via skill-based input using one or more input devices interpreted to horizontally move and fire the cannon platform 115. In one embodiment, the skill-based game concludes when either the entire wave of alien ships 112 is destroyed, one or more alien ships reach the bottom of the screen, or the cannon platform 115 is destroyed by shots fired. In another embodiment, the skill-based game concludes when a predetermined number of shots have been fired by the cannon 115 or a timer elapses. In one embodiment, the player is awarded a number of points corresponding to each alien ship destroyed, where a total accrued points for the player is reflected in the score meter 132. In other embodiments, the player score is determined by a total count of the number of alien ships the player destroys. In the embodiment shown in FIG. 4A, the player score is determined by the number of points a player accrues before the value of the timer meter 134 is exhausted, thereby ending the skill-based feature.

Referring now to FIG. 4B, after the skill-based feature ends, the interface 100 displays a selection screen 140 prompting the player for an election of a configuration option. The selected configuration option is applied to an upcoming non-skill-based feature of the wagering game customized using the configuration parameters of the selected configuration option. In one embodiment, the selection screen 140 displays a plurality of configuration options, each having parameters defining a specific volatility for a non-skill-based feature of the wagering game. In one embodiment, four volatility selection panels 142, 144, 146, 148 are shown on the selection screen 140, although all of the panels 142, 144, 146, 148 may not be available for selection by the player. For example, the only player-selectable configuration options available are those having a minimum required skill threshold exceeded by the player score reflected in meter 132. Any configuration options that are unavailable for player selection may be greyed out or not displayed.

The selection panels 142, 144, 146, 148 enable a player to select a configuration option for the non-skill-based feature having a set of corresponding parameters. The available configuration options may or may not maintain a static RTP of the wagering game as a whole. In some embodiments, the volatility of the non-skill-based feature is player-selectable, but the RTP of the wagering game always remains substantially constant. In one embodiment, the configuration options include parameters defining a combined volatility and RTP of the non-skill-based feature. For example, the non-skill-based feature may include awarding a number of free games (e.g., spins of a plurality of symbol-bearing reels with a randomly determined outcome), where the payout for each payline is adjusted using a specified multiplier. In one embodiment, the multiplier may be applied only to paylines that include a WILD symbol (while all non-WILD symbol winning paylines are not adjusted with the multiplier). The selection panel 142 specifies a configuration option having parameters providing twenty free games and adjustment of all payline wins having WILD symbols with a ×2 multiplier. Likewise, the selection panels 144, 146, and 148, specify configuration options having parameters providing ten, five, or two free games, and all payline wins having WILD symbols adjusted with a ×4, ×8, and ×20 multiplier, respectively. Other embodiments may include configuration options that include parameters adjusting all payline payouts with a specified multiplier. Configuration options having parameters may be available such that the RTP of the wagering game is kept substantially constant or is suitably altered. In differing embodiments, each player-selectable configuration option may define a set of parameters defining a distinct volatility and/or RTP of the wagering game, or specify parameters changing only aesthetic (or thematic) aspects of the wagering game.

The performance of the player during the skill-based feature (indicated by the score meter 132 derived from player skill-based input) dictates which configuration options are available for the player to select from. Player-selectable configuration options may be solely or partially dependent upon the value of the score meter 132. In one embodiment, the player obtains a greater choice of volatility selection during the non-skill-based feature when better performance during the skill-based feature (i.e., higher value of the score meter 132) is achieved. Thus, as a player improves at playing the skill-based feature (i.e., an increased level of skill is determined based upon the skill-based input), more configuration options may become available for selection upon completion. That is, a plurality of player-selectable configuration options may vary in number, and the configuration options may also vary. In accordance with a greater level of level of skill exhibited by the player during the skill-based feature, a greater number of player-selectable configuration options may become available. In some embodiments, the number of player-selectable configuration options stays the same, but one or more parameters of the configuration option may change to increase volatility, RTP, or other aspects of the wagering game. The number of player-selectable configuration options, as well as the parameters of each player-selectable configuration options, may be directly or indirectly based upon a determined and/or exhibited skill level for the player during a skill-based feature.

In one embodiment, a number of required points is required to unlock each configuration option. That is, each configuration option has a skill requirement (i.e., a required minimum score), indicated at the bottom of each selection panel 142, 144, 146, 148. In order for a configuration option to be player-selectable, the value of the score meter 132 must meet or exceed the minimum skill-based performance requirement. Upon selection, the corresponding set of configuration parameters of the player-selected configuration option is elected for the non-skill-based feature of the wagering game.

As shown in FIG. 4B, the score meter 132 reflects that the player's performance based on skill-based input exceeds the minimum performance requirement for unlocking the selection panels 142, 144, making these configuration options available for player selection. In response to a lack of required skill for the selection panels 146, 148, these are unavailable for player selection and are greyed-out. The level of determined skill of the player based on skill-based input during the skill-based feature (as measured by the value of the score meter 132) directly controls the display and player-selectable nature of the various configuration options (e.g., volatility and/or RTP options). Any player-selected set of parameters may apply to one or more upcoming skilled or non-skill-based features of the wagering game, depending on game design. Thus, based upon a player's skill-based performance, a plurality of configuration options having associated parameters (feature customization options) may be determined as available for selection by the player for gaming features. In one embodiment, the player is allowed to select a configuration option chosen from among a plurality of configuration options that directly defines the volatility and RTP of a subsequent non-skill-based feature of the wagering game.

Referring now to FIG. 4C, the player unlocks a greater choice of volatility selections (additional configuration options) in response to higher values of the score meter 132 meeting or exceeding the minimum skill-based performance requirement associated with each configuration option. Thus, in response to the player achieving a higher score value during the skill-based feature game (e.g., 5100 points as reflected in the score meter 132), all available volatility options (configuration options, each having associated parameters) are made player-selectable for upcoming gaming feature(s).

In one embodiment, after the completion of the subsequent feature(s), (e.g., a non-skill-based feature of the wagering game customized by any skill-based feature player elections), the score meter 132 is reset to zero and the player must play the skill-based feature again, when triggered, to determine available choices of configuration options for subsequent non-skill-based features. Alternatively, the score meter 132 may be accumulated over the duration of a playing session (e.g., until the player cashes out and/or no more credits remain on a credit meter 125 of the gaming machine) to provide persistent skill points, after which the score meter 132 is reset. In this case, higher-skilled players may achieve a greater range of selectable configuration options to choose from more quickly than lower-skilled players, and any determined level of choice achieved by the player remains available without having to re-play the skill-based game feature during the session.

Figure 5A:
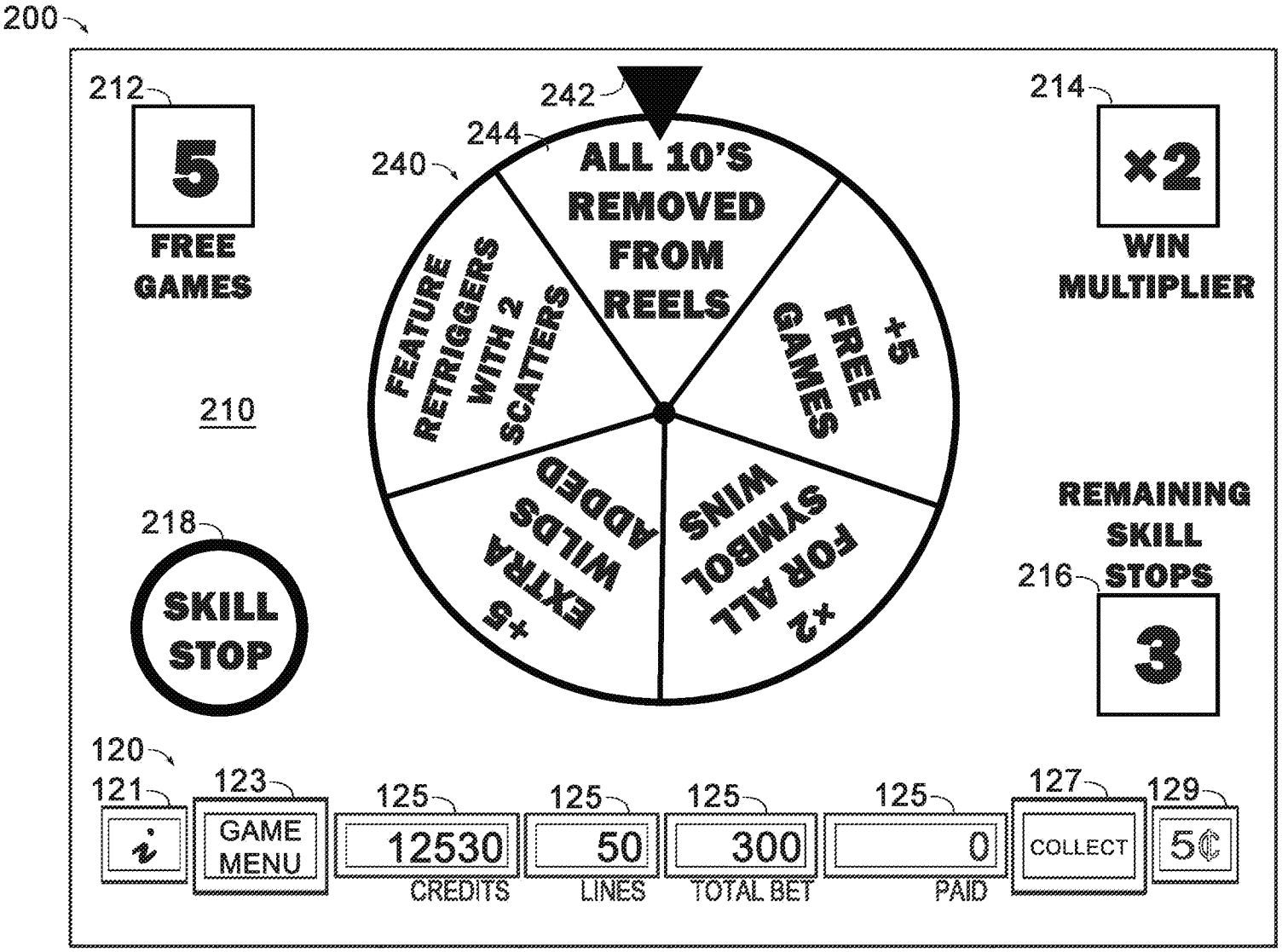
FIGS. 5A-5B are images of an exemplary visual interface for skill-based volatility selection of a non-skill-based wagering game feature displayed on a screen of a gaming machine, according to an embodiment of the present invention.
Figure 5B:
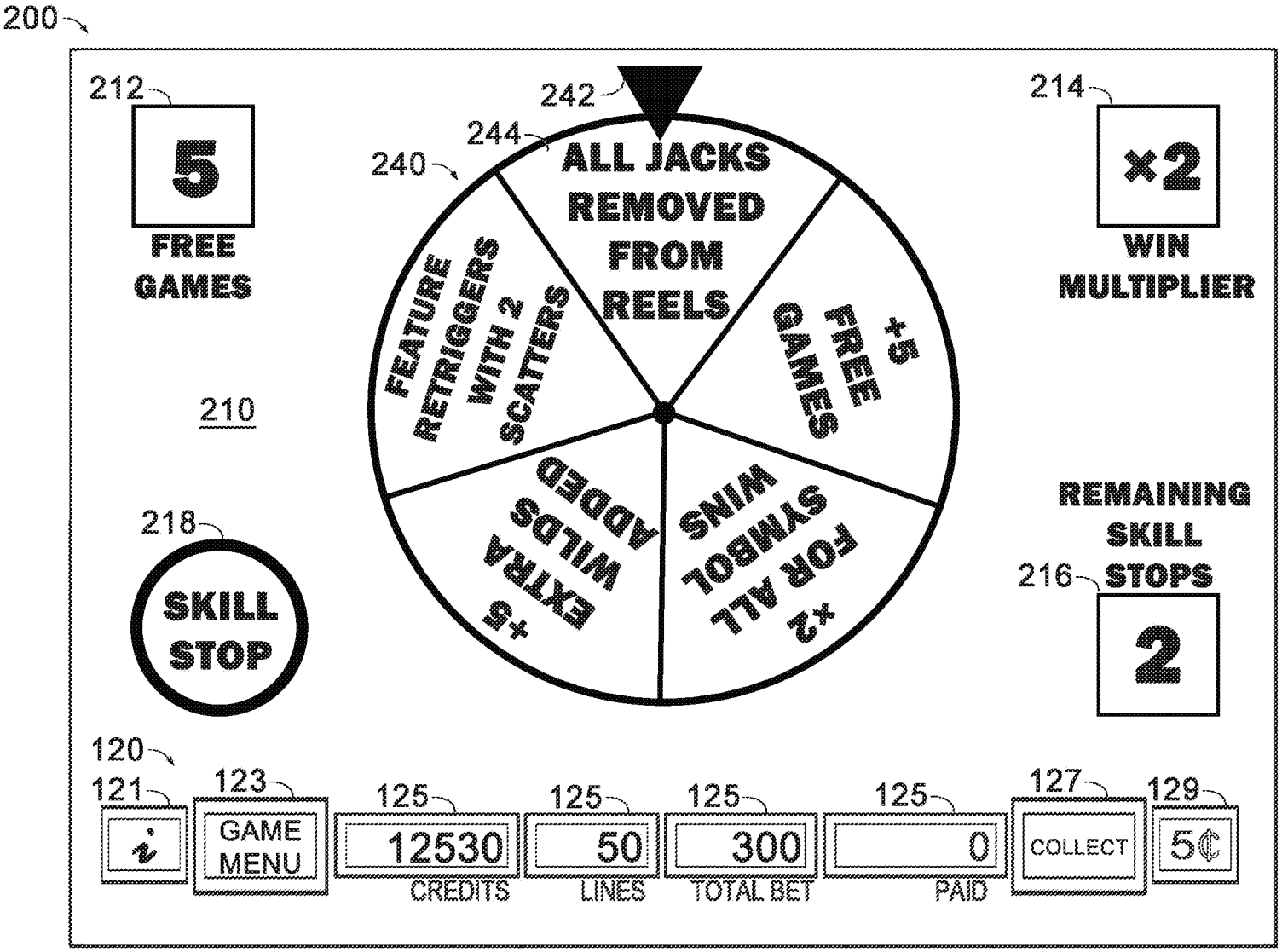

Referring now to FIGS. 5A-5B, an embodiment having an interface 200 exhibits how a non-skill-based portion of a wagering game may be customized directly by skill-based input (i.e., player performance during a skill-based feature). In one embodiment, the skill-based game enables the player to control how the wagering game, or portion thereof (e.g., non-skill-based feature, bonus game, etc.), is customized in accordance with the skill-based performance of the player. In one embodiment, the player receives a predetermined number of skill-based selections (i.e., attempts) for customizing features of the wagering game and the corresponding features are customized accordingly for one or more subsequent features. The predetermined amount of skill-based input player selections may be random, pseudo-random, or determined from an additional skill-based feature.

As shown in FIG. 5A, an interface 200 is shown to the player when a skill-based feature begins in one embodiment. The interface 200 includes a gaming section 210, and a lower banner 120. The lower banner 120 may function as previously described, making available and reporting various options and aspects of the current wagering game in one or more iconic, textual, or meter-based components.

The gaming section 210 includes a set of interface components used to display and conduct the skill-based feature. In one embodiment, the gaming section 210 includes a free-game meter 212, a win-multiplier meter 214, a remaining skill-stop meter 216, a skill-stop button 218, a wheel 240, and a pointer 242. The free-game meter 212 displays a current number of free-games and the win-multiplier meter 214 displays a current multiplier accrued by the player selections during the skill-based feature. A number of configuration parameter options may be used for customization of an upcoming non-skill based portion of the wagering game on behalf of the player. Accordingly, the multiplier specified by the win-multiplier meter 214 will adjust each payline payout of the free-game outcome for each of the performed free game instances specified by the meter 212. In other embodiments, the win-multiplier meter 214 may relate specifically to certain types of paylines, winning combinations, or other gaming features.

In one embodiment, the skill-based feature takes the form of a spinning wheel game shown by interface 200. Each skill-based attempt (i.e., skill-based input) by the player is provided as a "skill stop". The meter 216 displays a number of skill-stop attempts remaining for the player to select and accrue further value to meters 212, 214, or otherwise modify (customize) one or more parameters for upcoming feature(s) by defining a corresponding configuration option. During each skill-stop attempt, the wheel 240 remains spinning at a relatively fast rate and is only stopped after the player hits the "skill stop" button 218, providing a skill-based input. The player can use the button 218 to provide the skill-based input and stop the wheel 240 at a particular segment adjacent to pointer 242. Each segment of the wheel 240 is associated with a specific attribute (i.e., one or more parameters) for defining a configuration option used for customizing upcoming events of the wagering game (e.g., during a non-skill based feature).

In other embodiments, more or fewer interface components may be integrated into the interface 200, displaying or omitting meters indicating various parameters used for defining the configuration option and customization of features of the wagering game. For example, a meter displaying the number of extra WILD symbols that are added to a set of symbol-bearing reels used to determine outcomes in each of the free-games of a non-skill-based feature. A list (or set) of symbols present on one or more of the reels, etc., may also be visually indicated to inform the player of the configuration option customizing one or more features of the wagering game.

Each segment of the wheel 240 corresponds to a particular parameter of the configuration option that is used to customize an upcoming non-skill-based feature of the wagering game. The corresponding parameters modified by results of stopping the wheel 240 may include any feasible variation of gaming attributes, including payline multiplier(s) for one or more types of winning combinations of symbols, additional free spin awards or skill-stop attempts, reel symbol additions/removals/replacements, feature addition/upgrade (e.g., increasing odds of feature re-trigger through the addition of feature-triggering symbols or criteria to one or more reels, addition of sticky WILD symbols, a roaming WILD symbol reel, a new bonus game or gaming feature, etc.), among various others. In one embodiment, the wheel 240 may impact configuration parameters relating to the skill-based feature itself, for example, slowing the wheel rotation, expanding the pointer 242, or adding, removing, or adjusting the size or effect of various sections of the wheel 240.

After stopping the wheel 240 such that the pointer 242 is adjacent to a particular designated segment 244, the associated parameter corresponding to segment 244 is accrued or accounted for (e.g., incremented by a meter 212, 214) within the configuration option. In one embodiment, the parameter corresponding to the designated segment 244 is immediately changed to indicate an updated configuration option. After a completed skill-stop attempt, one or more segment(s) of the wheel 240 may be unchanged, removed from the wheel 240, updated by modification of one or more associated parameters of the configuration option, replaced by another segment or configuration parameter, etc., such that wheel 240 exhibits a different structure, number of segments, size of segments, modified shape or movement, etc. Further, the structure of the wheel 240 may be initially assigned having differing sizes, perhaps significantly so, such that highly desired or valuable sections may be relatively difficult to obtain via a player's skill-based input. For example, the wheel 240 may be initially configured having relatively wide segments corresponding to lower volatility options and relatively narrow segments for higher volatility options. This type of initialization increases the desirability of high volatility selections and steers newer unskilled players into lower volatility selections. One or more segments of the wheel 240 may expand or shrink to further increase difficulty in subsequent skill-based input selections of designated segments 244 and associated attributes.

In one embodiment, in response to a segment remaining unchanged on the wheel 240 following a player selection, the same corresponding configuration parameter remains and may be accumulated or accounted as part of the adopted configuration option over subsequent player skill-stops. For example, each time the player stops the wheel 240 on the "+5 FREE GAMES" segment, five spins are added to the free-game meter 212. In some cases, it may be preferable to prevent a configuration parameter from being applied more than once, so the segment associated with that configuration parameter may disappear from the wheel 240 entirely. Alternatively, the value of the configuration parameter associated with the segment may be modified or substituted with an acceptable parameter.

In one embodiment, consider a skill-based feature of the wagering game where the player provides a skill-based input to actuate the skill-stop button 218 as the wheel 240 rotates, displayed by interface 200 in FIG. 5A. The actuation of the skill-stop button 218 may be a result of one or more input devices 50, e.g., a mechanical button on a button deck or a corresponding region of a touch screen. When the skill-based input is received and the wheel 240 stops in response to the actuation, the pointer 242 points to a designated segment 244 specifying a corresponding parameter (i.e., "ALL 10's REMOVED FROM REELS"). In an embodiment where the symbol-bearing reels utilized for generating outcomes for the non-skill-based feature are populated with 10, JACK, QUEEN, KING, ACE, WILD, and SCATTER symbols, this parameter indicates that the reels for non-skill-based feature will be suitably modified, removing the lowest paying symbols on the reels (i.e., all the "10" symbols).

In response to the designated segment 244 being identified as player-selected, the value of remaining skill-stops reflected in meter 216 is decremented and updated (now two remaining skill stops remain as reflected in meter 216), and the designated segment 244 is updated to reflect "ALL JACKS REMOVED FROM REELS" as a new parameter for this segment should selection of this segment then occur (FIG. 5B). That is, a future player selection of the same designated segment 244 causes removal of the currently lowest paying symbols on the reels (now JACKS, since all 10's have been removed). In one embodiment, reel symbol removal may be indicated by a meter striking out eliminated symbol types removed from the reels or showing the symbols that remain on the reels.

For each skill-based input and associated skill-stop selection, the player stops the wheel 240, an accumulation of parameters and/or attributes are accounted in the configuration option, and meter 216 reflecting any remaining skill stops is decremented. This repeats until the value of the meter 216 is exhausted, ending the skill-based feature. The accrued parameters (e.g., number of free games, applied multiplier(s), symbol composition on reels, etc.) are stored to comprise the configuration option and are applied during one or more upcoming features of the wagering game. Only those parameters and attributes that are associated with the segments stopped adjacent the pointer change the configuration option applied during the upcoming features. Thus, the player is able to skillfully control how the upcoming features of the wagering game may be customized based on an ability to stop the wheel next to desired parameters or attributes. Other types of skill-based games may be used instead of a rotating wheel 240. For example, a skill-based feature may use "shots" in a shooting game, where the player attempts to shoot targets associated with attributes that are then applied to an upcoming feature as the player successfully hits each target. Accordingly, a configuration option is generated incorporating the parameters and attributes and used for conducting the subsequent features.

Figure 6A:
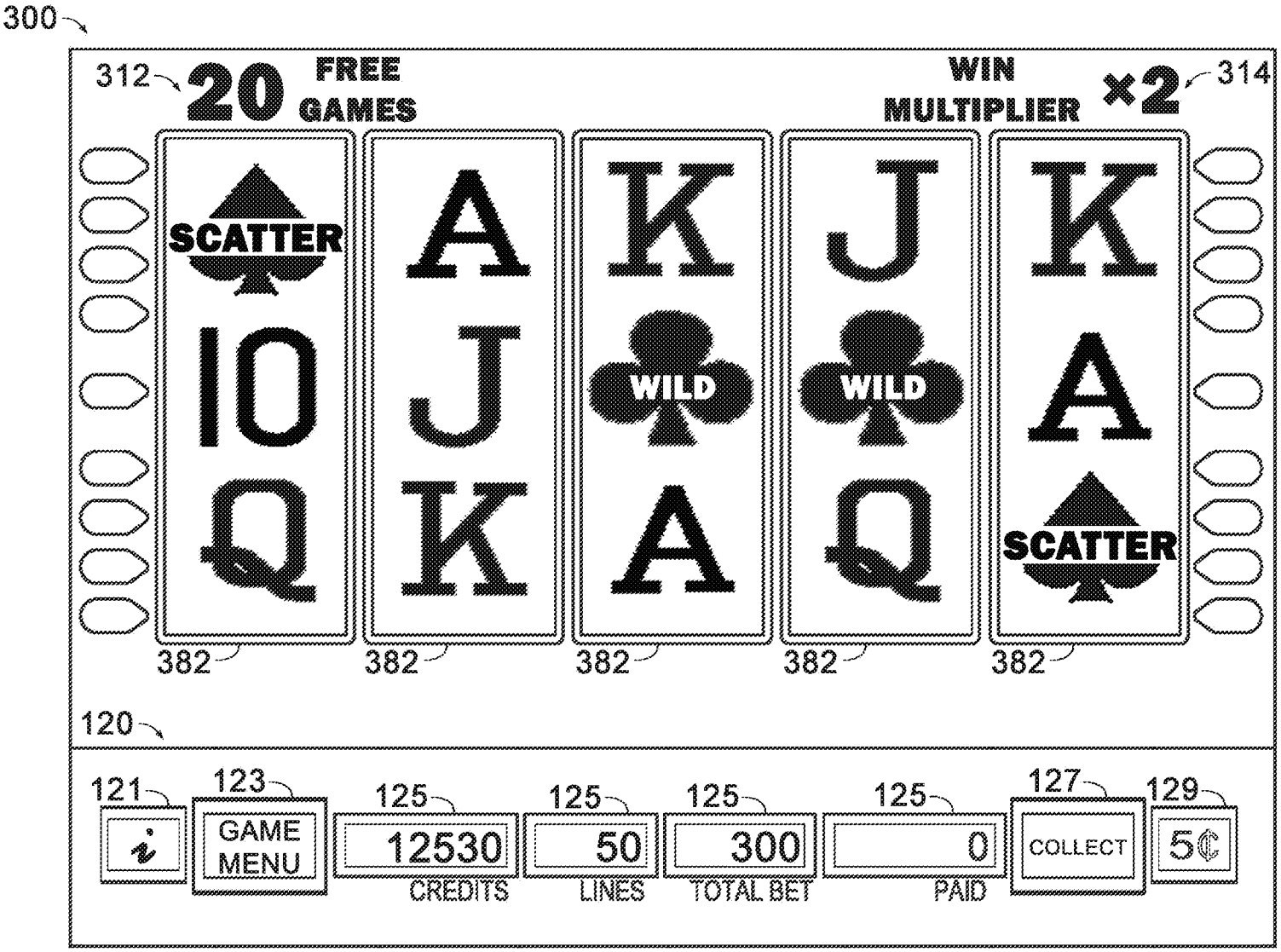
FIGS. 6A-6B are images of an exemplary visual interface for a player customized, non-skill-based feature of a wagering game displayed on a screen of a gaming machine, according to an embodiment of the present invention.
Figure 6B:
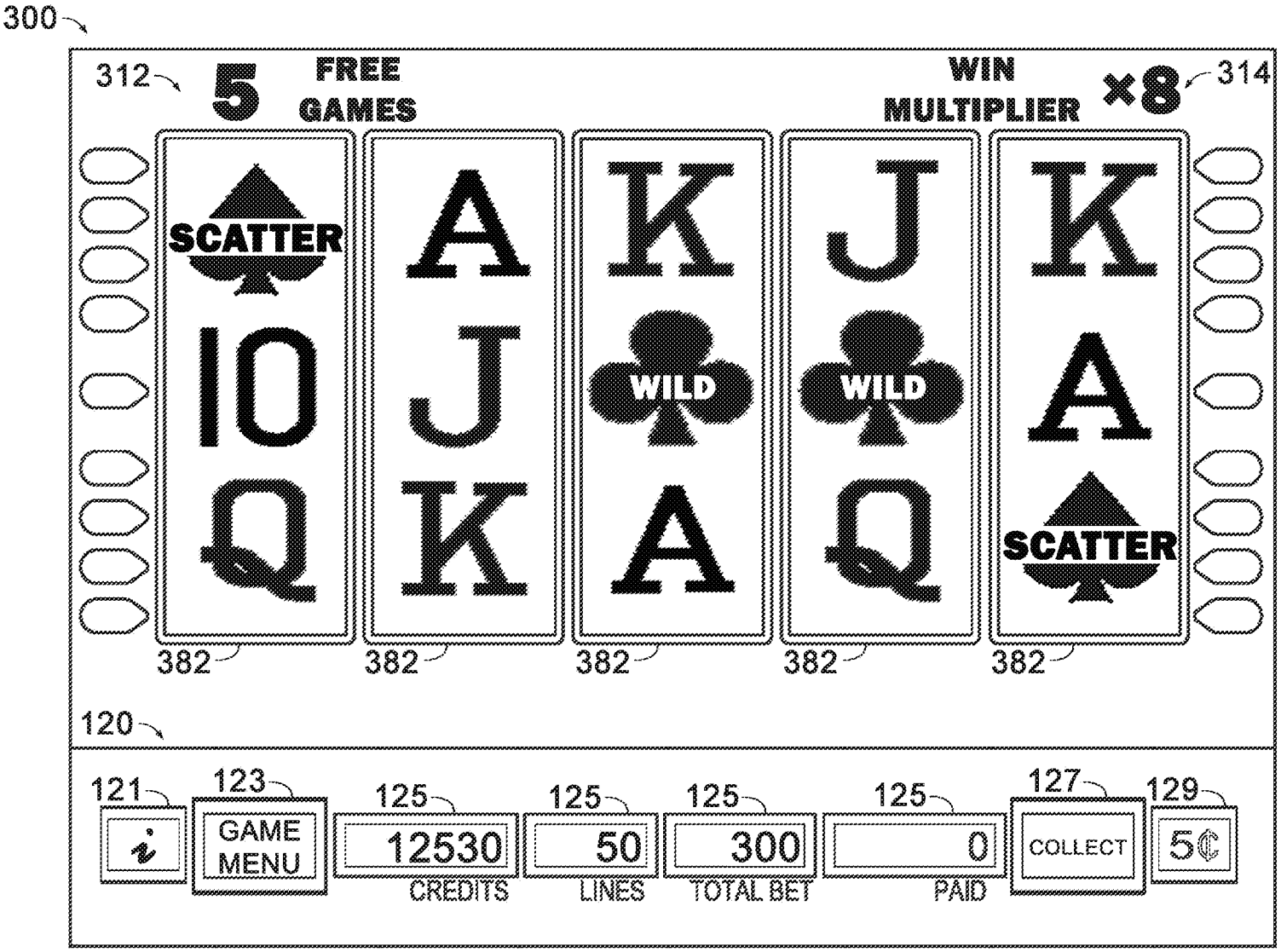

Referring now to FIGS. 6A-6B, an example of an interface 300 for a non-skill-based feature of a wagering game that is customized using a configuration option having associated parameters resulting from a player during a skill-based feature. The interface 300 includes a free-games meter 312 and a payout-multiplier meter 314 that are utilized together to determine a collective outcome for the non-skill-based feature that uses the symbol-bearing reels 382 to generate individual outcomes. In one embodiment, the interface 300 displays a non-skill-based feature conducted in accordance with the results of a skill-based feature as shown in FIG. 5A. For example, consider a player beginning a skill-based feature with five free games, a "×2" initial multiplier, and three skill-stop attempts, stopping the rotating wheel 240 at the "+5 free games" designated segment 244 during each skill stop attempt. A resulting non-skill-based feature of the wagering game is customized using a configuration option that includes twenty free games having an unchanged payout-multiplier (×2) (shown in FIG. 6A). In another example, consider a player playing the above skill-based feature stopping the rotating wheel 240 at the "×2 for all symbol wins" with each of the three skill-stop attempts. The corresponding increase in the win multiplier 214 of the configuration option may be either additive or multiplicative, for example, the resulting win multiplier 214 may reflect "×6" (where the accrued multiplier is additive: ×6=×2+×2+×2) or "×8" (accrued multiplier is multiplicative: ×8=×2·×2·×2). FIG. 6B shows the interface 300 reflecting a configuration option utilizing a multiplicative increase of the win multiplier meter 314, achieved in response to three identical player parameter selections.

In another example, a player's skill-based input resulting in other combinations of selected designated segments 244 of the wheel 240 may result in a suitably altered configuration option comprising various other parameters for a non-skill-based feature, for example, by removing symbols from one or more of the reels 382, changing the re-triggering criteria of the skill-based feature to two scatter symbols, and/or adding WILD symbols to one or more of the reels 382, in addition to the provision for additional free games and/or a higher multiplier.

Thus, during a skill-based feature, a player is given a series of skill-based opportunities to provide skill-based input and alter (and define) the parameters of a configuration option for a non-skill-based feature of the wagering game, including volatility and/or an overall RTP of the wagering game. In FIG. 6A, the volatility of the non-skill-based feature is relatively low as a result of the statistical expectation for more frequent and lower valued wins during each awarded free game (the value of the free-game meter 312 is high and the win multiplier meter 314 remains unchanged from the initial value "×2"). In FIG. 6B, the volatility is relatively higher (the value of the free-game meter 312 is unchanged from the initial value of five and the win multiplier meter 314 is increased to "×8"), having potentially substantial higher payouts for each awarded free game. In both non-skill-based features, the RTP of the two wagering games is substantially identical. However, in the event a player selects a mix of these two configuration parameters (skillfully selects a mix of free spins and multiplier increases), the RTP of the wagering game may resultantly increase in favor of the player.

The combinations of the parameters of the configuration option that impacts the one or more (skill-based or non-skill-based) features of the wagering game may be limited or formulated purposefully to maintain the RTP of the wagering game as a whole. The volatility for each gaming feature may be individually modified by spreading application of an attribute (e.g., a win multiplier) to a specific number of different reel symbols to provide a low volatility game feature, or limiting the attribute to a particular reel symbol to provide a high volatility game (maintaining the number of free spins provided in the game feature in both cases). Other attributes and combinations of attributes may be used to provide a great deal of flexibility during the presentation of a skill-based feature and generating a configuration option that customizes a non-skill-based feature of the wagering game based player skill inputs. The manipulation of specific feature parameters of a particular configuration option enables a wide variety of player-initiated and selected customization of features, either with or without significant modification of the RTP of the wagering game.

Referring now to FIGS. 7A-7E, an embodiment is shown having an interface 400 exhibiting how a range of player-selectable choices for a non-skill-based feature of a wagering game may be narrowed over time. The interface 400 displays a pick-dependent skill-based feature of a wagering game in one embodiment. In this embodiment, when the skill-based game feature is triggered (e.g., randomly, by specific symbols on symbol-bearing reels), a player is presented with a concentration-style game where the player selects cards from an array of cards dealt face down and attempts to match selected cards having the same symbol or parameter provided on the face of the cards.

In one embodiment, a player must select and reveal at least a pair of matched cards in order for the corresponding parameter to be applied as a configuration option during a non-skill-based feature. The number of selected matching cards (and/or any other criterion) for concluding the skill-based feature may be highly variable. In one embodiment, the picking game concludes in response to a player revealing a particular number of matching cards. For example, three or more of the same cards may be required to be selected, revealed, and matched before an associated parameter or attribute is added to a configuration option applied to an upcoming game feature. In one embodiment, the number of picks assigned to the player is unlimited for the duration of the skill-based game until the player reaches the requisite number of matching cards. Once the requisite number of cards are revealed and matched, one or more associated parameters comprise the configuration option that is applied to one or more upcoming features of the wagering game, for example, a non-skill-based feature. In one embodiment, the wagering game maintains a fixed RTP percentage regardless of any configuration parameters selected or triggered on behalf of the player choices.

In one embodiment, while the player is attempting to match cards, a timer controls which cards (and corresponding associated configuration parameters) remain available for the player to select to make matches. When a specific amount of time elapses, any cards having any excluded parameters or attributes are removed and are no longer available for selection by the player. Thus, only cards having selectable configuration parameter options remain available for selection at any given time. As the timer continues to progress, further cards may be removed from the pick field until only a single type of card remains (forcing an automatic match and player selection). When only a single configuration parameter remains on the corresponding remaining cards, the associated parameter or attribute is automatically selected for the configuration option applied to the non-skill-based feature. The timer may indicate a remaining amount of time for a player to make selections in a single stage of the skill-based feature, or a combined available selection duration for the entire skill-based feature.

Alternatively, a number of selected picks to make a match may be limited to a particular number. For example, a player may be given three distinct chances to select matching cards, and if the player is unsuccessful in making a match, a non-skill-based feature begins with one or more predetermined configuration options (without any further player choices). A combination of player selections and one or more timers may also control certain operational specifics of the skill-based feature, for example, in the event that a player is unable to complete the selection process within a specific amount of time.

Figure 7A:
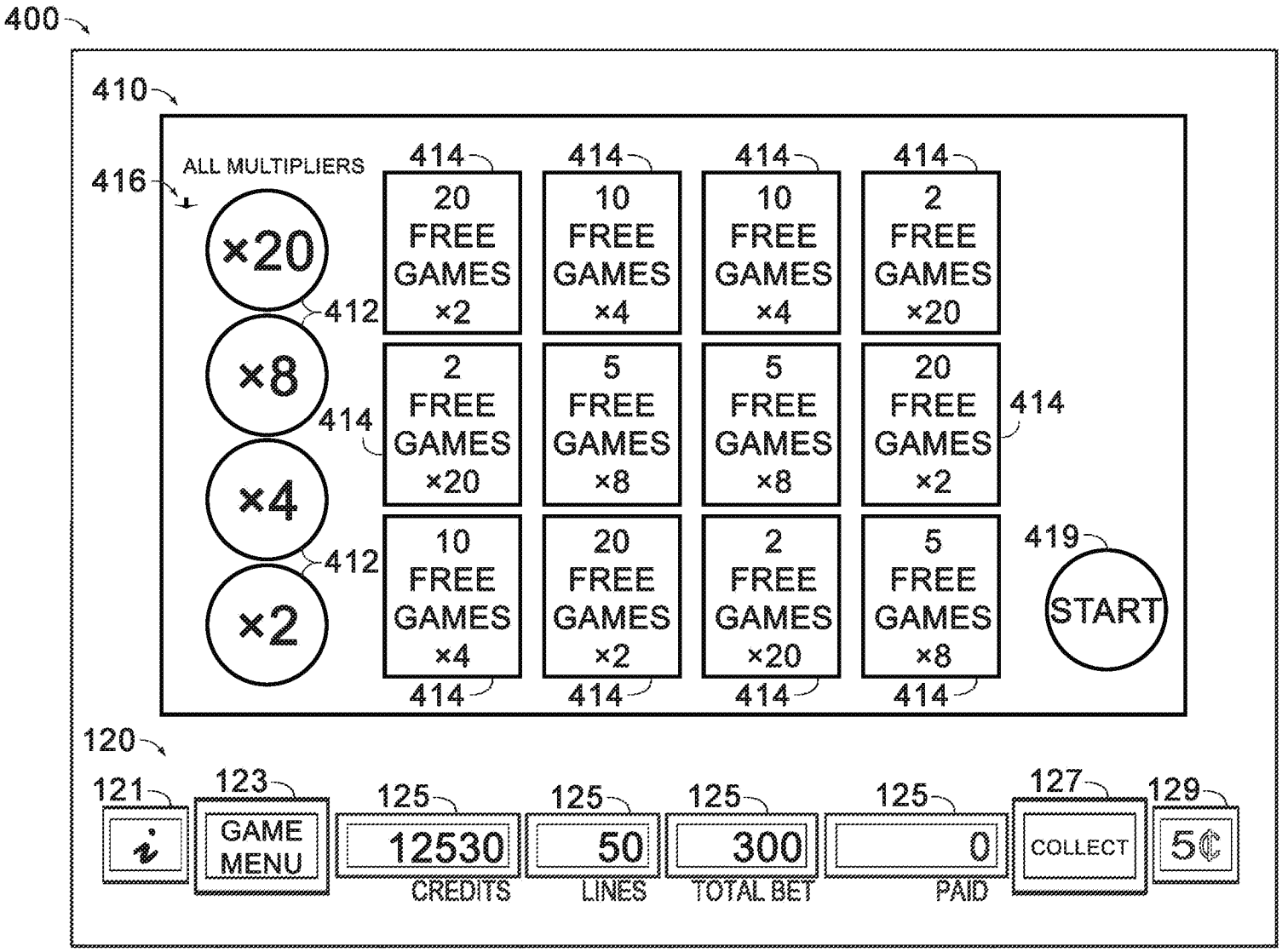
FIGS. 7A-7E are images of an exemplary visual interface for a time-based, skill-based volatility selection feature for customizing a non-skill-based wagering game feature displayed on a screen of a gaming machine, according to an embodiment of the present invention.

In one embodiment shown in FIG. 7A, the interface 400 includes a pick-field interface 410 having a set of available multiplier indicators 412 (showing parameters available for selection by the player), an array of revealed cards 414 (available indicia for player selection), a timing indicator 416, and a skill-based feature START button 419. Alternatively, the timing indicator 416 may be accompanied by or substituted with a digital or analog timer. The START button 419 may receive player skill-based input via a physical gaming machine deck button (e.g., button 260) or be otherwise implemented via another device (e.g., touch screen 24), and have any type of descriptive label (e.g., BEGIN, READY, GO, etc.).

Each of the cards 414 has an associated set of configuration parameters displayed on its face so a player may observe the parameters or attributes associated with each card prior to making selections. In one embodiment, there are four distinct volatility options, each having an associated number of free games (e.g., spins) and corresponding multiplier (e.g., for modifying payouts of all winning symbol combinations). The configuration parameters for each of the cards 414 are initially displayed to the player prior to beginning the matching feature portion of the skill-based feature. That is, the configuration parameters defining the available volatility options for each card 414 are revealed face-up prior to being hidden (e.g., turned face-down) when player selection begins.

In one embodiment, the player is given an opportunity to examine the revealed cards 414 in the card pick-field prior to initiating selection skill-based input. The progression of the timing indicator 416 initiates the removal of cards 414 from the pick-field, starting with the cards 414 having the highest volatility configuration parameters. In another embodiment, removal of the cards 414 only occurs after the matching feature has been initiated (i.e., while the player attempts to make matches). Further, other embodiments may include limiting a number of picks to a particular timeframe or a specific limit. For example, if a player has not made a match within a predetermined timeframe or falls short of a minimum number of picks during the timeframe, choice options are removed or a choice is automatically performed on behalf of the player.

In one embodiment, selection of the button 419 on the interface 400 causes the selection process to begin and initiates card selection matching guesses in the matching feature. Prior to initiation of the matching feature, a player is given a predetermined amount of time (indicated by timing indicator 416) to examine the cards 414 and remember the position of cards 414 having a particular associated parameter. As the matching feature begins, the faces of the revealed cards 414 become hidden and the player is prompted to make selections of a requisite number of matching cards to determine a player-selected configuration option. In one embodiment, the configuration option is applied to an upcoming non-skill-based feature of the wagering game that includes randomized free games granted on symbol-bearing reels as detailed in FIGS. 6A-6B. The parameters of the player-selected configuration option are used to determine the outcome of the non-skill-based feature of the wagering game.

In one embodiment, the longer the player delays initiation of the matching feature (pressing the button 419 to begin the concentration game), selectable indicia having ineligible parameters are removed from the pick field indicia array. For example, the range of player-selectable configuration options diminishes as the player takes time to memorize the revealed card 414 positions until the selection and matching portion of the feature is initiated by actuating the button 419. The timing indicator 416 may be used to visually indicate the elapsed time and the impact upon the pick-field array.

Figure 7B:
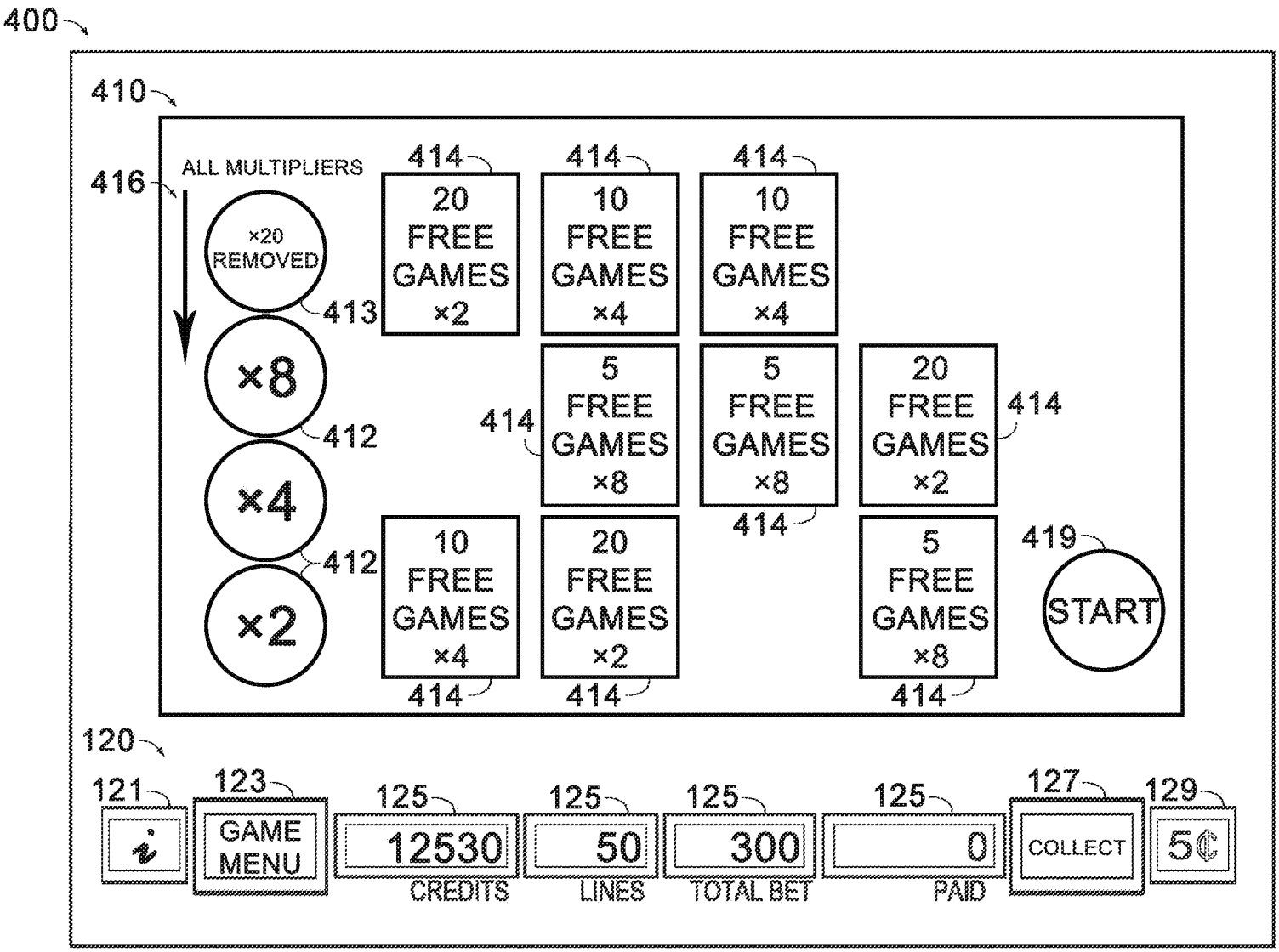

Referring now to FIG. 7B, after a predetermined period of time elapses (e.g., as indicated by the timing indicator 416), the indicia of cards 414 corresponding to the highest volatility option (which is often considered more preferable to play than the lower volatility options) are removed from the pick-field card array, reducing the available configuration options for player selection. Additionally, a visual indicator 413 may report the removal of availability of this configuration option.

Figure 7C:
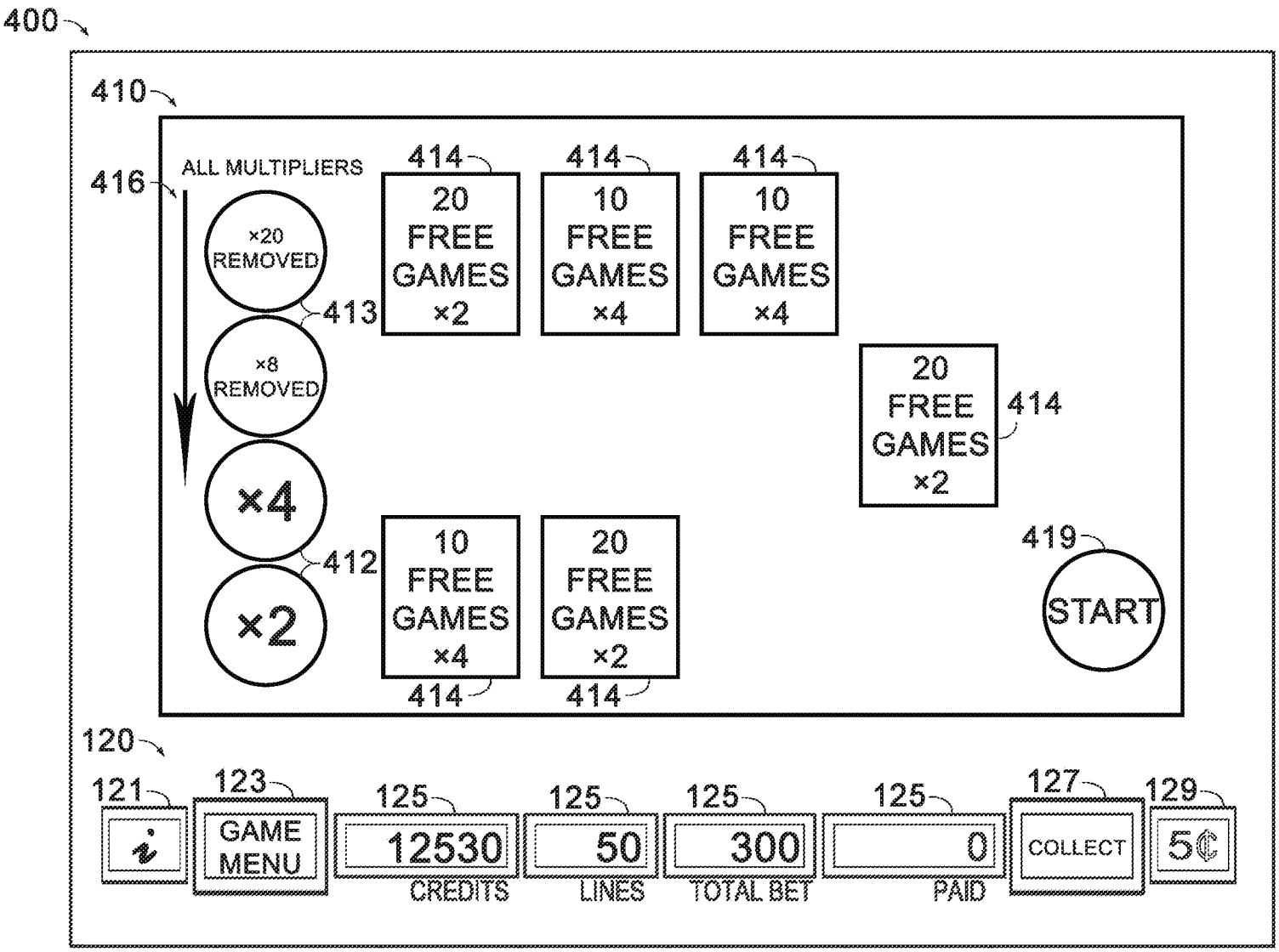

Referring now to FIG. 7C, as the timer 416 progresses further, additional cards 414 having additional volatility options may also be removed from the array and additional indicators 413 are updated to reflect what configuration options remain for player selection and matching. Due to the length of time taken for the player to initiate the selection and matching process, the highest and second highest volatility options (×20 and ×8 multipliers) are removed from the card array. In one embodiment, if time continues to diminish, available configuration options will continue to be removed until only the cards 414 having the least volatility remain, and the lowest volatility option will be applied automatically to the upcoming non-skill game feature as a configuration option. However, in response to the player actuating the button 419 before time is exhausted, the selection and matching process of the gaming feature maintains the indicia of the cards 414 having player-selectable volatility options.

Figure 7D:
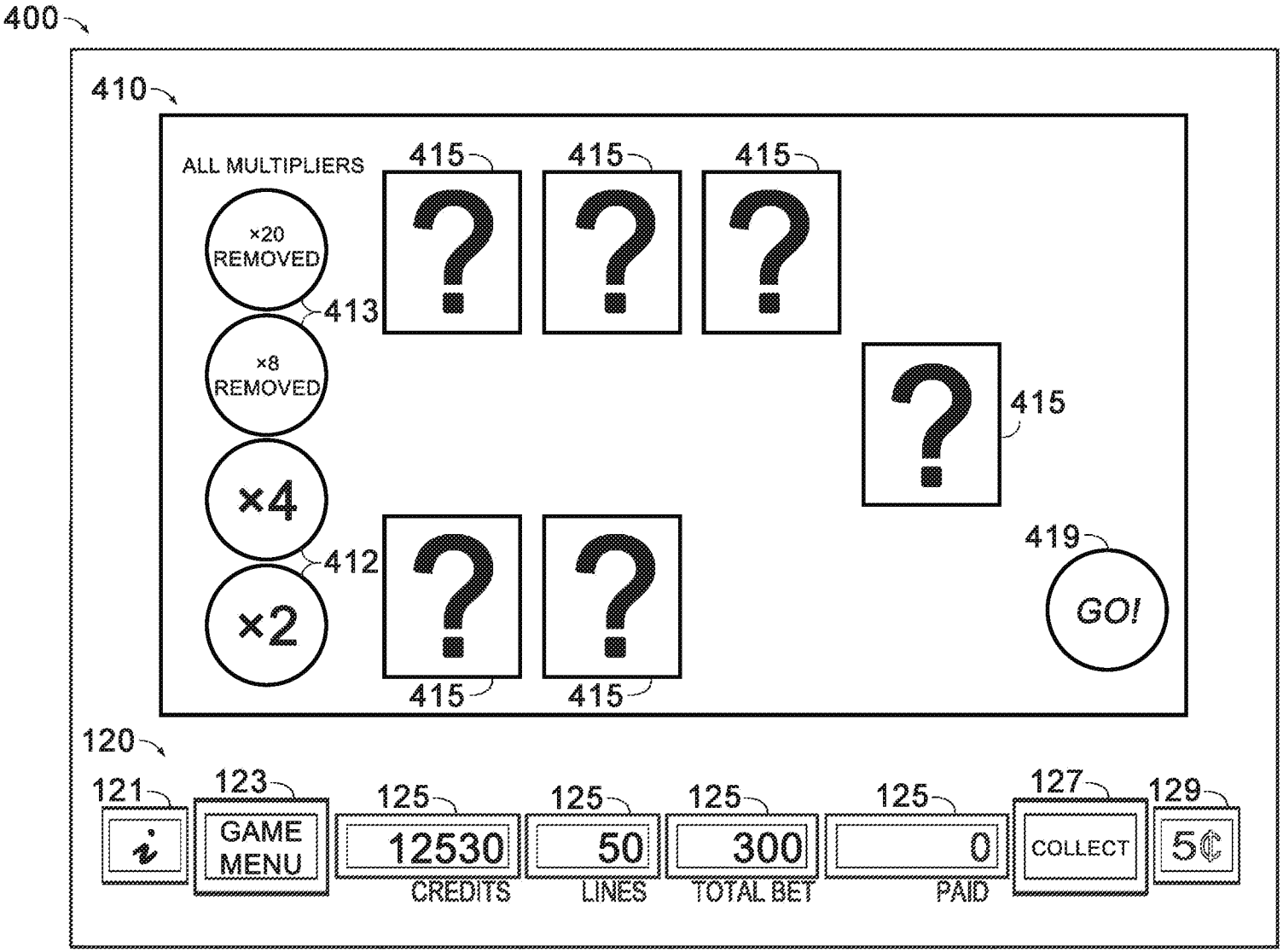

Referring now to FIG. 7D, after initiating the selection and matching process of the skill-based feature (e.g., pressing the START button 419), the revealed cards 414 are converted to hidden cards 415 and the button 419 changes to indicate a change in function (e.g., to submit skill-based input of matching guesses). A player uses one or more input devices to provide the skill-based input and select hidden cards 415 from the card array in an attempt to reveal matching cards. In one embodiment, a player is prompted for selecting three of the hidden cards 415 indicia from the cards array, and a match occurs when the three selected indicia are all revealed cards 414 of the same type.

In one embodiment, if the player does not form a timely match in a predetermined amount of time (or after a predetermined number of attempts), the player may be assigned a default (e.g., the lowest possible) volatility option automatically as a configuration option. In another embodiment, hidden cards 415 may be removed from the pick-field card array as the timing indicator 416 increases or in response to each selection and matching attempt. Thus, in order to achieve a desired configuration option having a set of configuration parameters corresponding to a specific volatility, a player is required to perform with sufficient skill to match a requisite number of cards 415 within the predetermined amount of time or a predetermined number of attempts.

In another embodiment, concentration-style matching process may be provided as a number of successive levels that the player progresses through, with each level becoming progressively harder. For example, consider a selection and matching process having four levels: a $1^{st}$ Level having four different symbols populating an array of 4×1 positions, a $2^{nd}$ Level having four different symbols populating an array of 4×2 positions, a $3^{rd}$ Level having four different symbols populating an array of 4×3 positions, and a $4^{th}$ Level having four different symbols populating an array of 4×4 positions. During the $1^{st}$ level, an array of symbol positions are revealed to the player, each position being associated with one of four different symbols. The symbols are then concealed and one of the symbols is randomly selected and displayed. The player must correctly match the displayed symbol with the same symbol from the array by selecting a position of the array to reveal. If the player selects the correct position, the game progresses to the $2^{nd}$ level, the difficulty being increased by requiring the player to correctly reveal twice as many positions, with each level unlocking a higher selectable volatility during the free game round. When completed, the player may be prompted for selection of a particular configuration option.

Figure 7E:
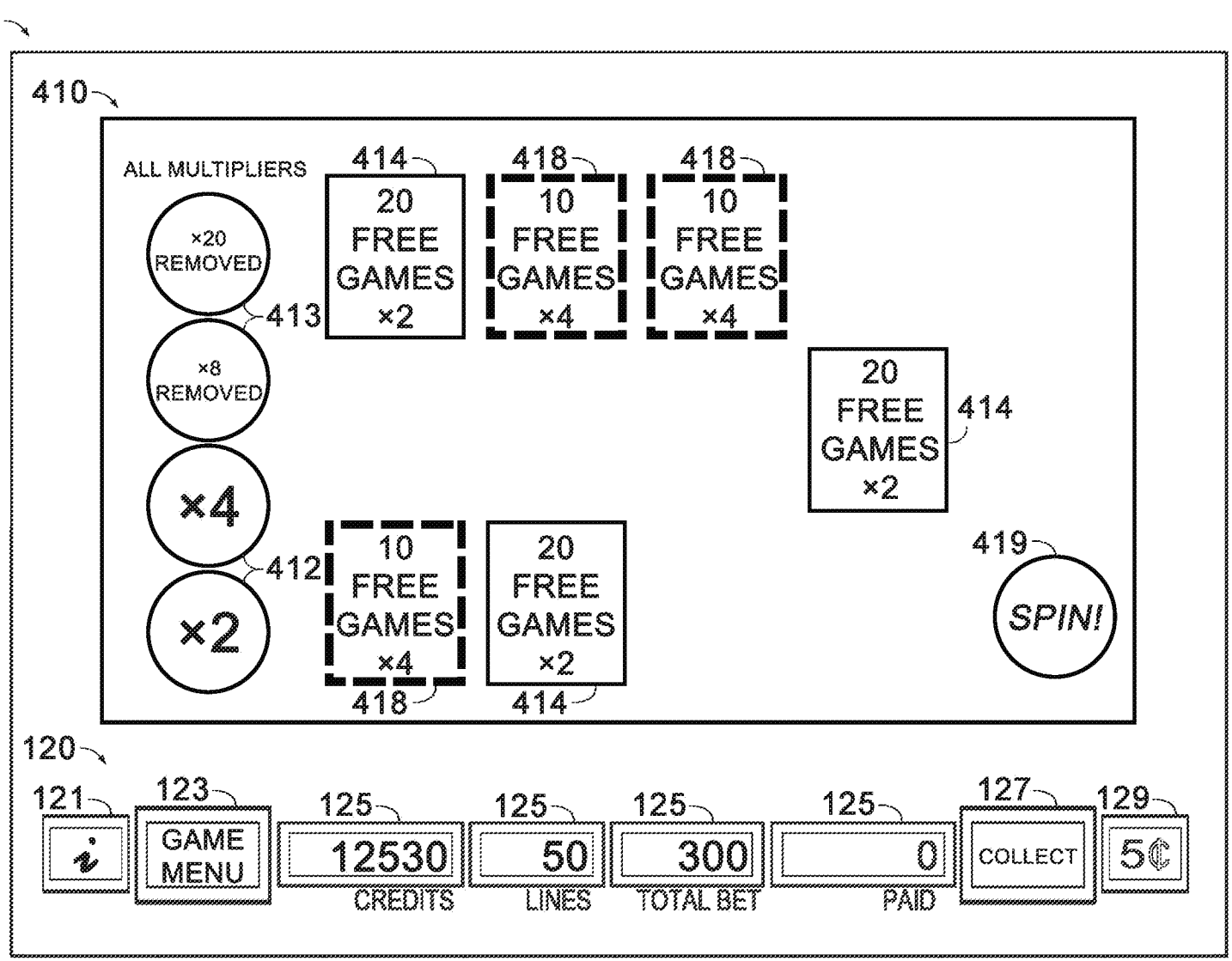

Referring now to FIG. 7E, in response to a player succeeding in selecting and matching a requisite number of cards 415 in the allotted time (or as a result of an automatic selection process), the matched cards 418 are revealed and highlighted to visually indicate the corresponding player-selected volatility parameters and the corresponding player-selected configuration option. Other indications of the determined configuration parameters may be additionally or alternatively displayed (e.g., in a banner) when the configuration parameters are determined or assigned. Any remaining cards 414 may also be revealed prior to ending the matching feature. Once a match is determined, the player is prompted to actuate button 419 to initiate the non-skill-based feature of the wagering game (e.g., a non-skill-based feature as shown in FIG. 6A-6B) in accordance with the determined configuration option.

In general, the more skill that a player exhibits during a skill-based game feature, the more configuration option choices are available to the player to customize specific features of the wagering game, such as non-skill-based feature bonus games. In this way, player controlled customization of wagering game features may be earned through skill-based input, rather than being bought, randomly assigned, or freely given. Accordingly, the invention makes the wagering game more entertaining and/or satisfying by allowing the player to customize the wagering game in accordance with their ability or skill during one or more skill-based gaming features.

Figure 8:
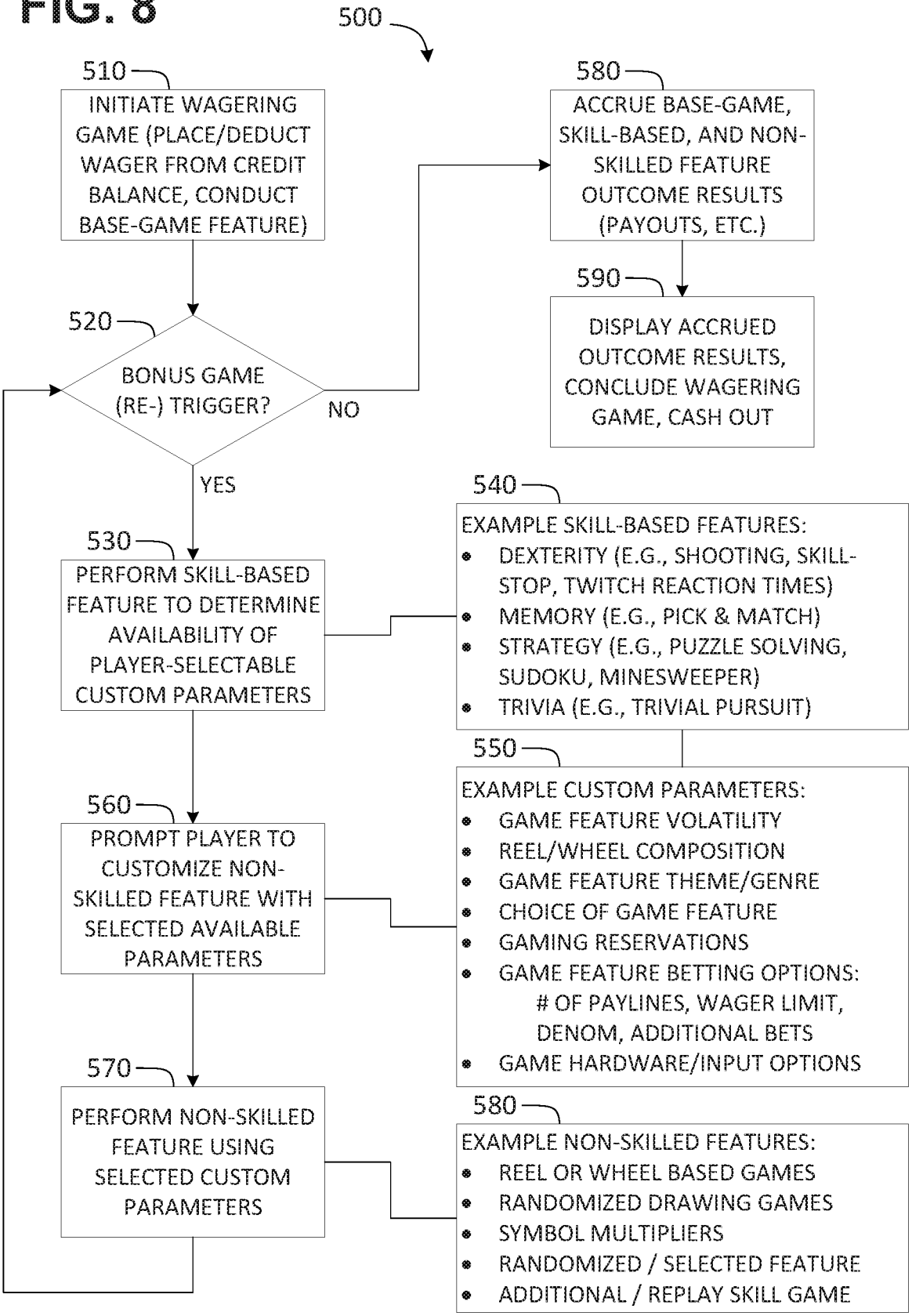
FIG. 8 is a flowchart for a data processing method corresponding to instructions executed by a controller in accord with at least some aspects of the disclosed concepts.

Referring now to FIG. 8 represents a data processing method 500, described by way of example above, corresponding to at least some instructions stored and executed by the game-logic circuitry 40 in FIG. 2 to perform the above described functions associated with the disclosed concepts. In one embodiment, a wagering game comprises a base game and a bonus game that is triggered in the base game. The bonus game includes a skill-based feature (that includes one or more player selection processes) and a non-skill-based feature that is customized in accordance with a configuration option comprising configuration parameters derived from player skill-based input selections. The availability for the range of player-selectable configuration options is based upon the player's performance in the skill-based feature.

In step 510, the process 500 begins when the wagering game is initiated. As discussed prior, initiation of the wagering game may occur in response to the use of one or more input devices 50 (e.g., button 26). In one embodiment, an actuation of a physical button labeled "spin reels" initiates the wagering game a specified wager amount, having a specified number of paylines, at a specific denomination per credit, etc. The placed wager is deducted from a balance associated with the wagering game, typically displayed on one or more meters (e.g., meter 84, 125) on one or more displays (e.g., display 18).

In step 520, a decision is made as to whether a bonus-game triggering event in the base-game of the wagering game has occurred (or alternatively, whether a re-trigger event has occurred in a bonus game). In one embodiment, a bonus-game triggering event occurs as part of the outcome of the base-game, for example, as a result of the displayed symbols of a set of symbol-bearing reels. In another embodiment, the event may be randomly triggered using an RNG, being fully independent from the outcome of any other features of the base-game (e.g., the symbols displayed by a set of symbol-bearing reels).

In step 530, in response to a bonus-game trigger, a skill-based feature of the wagering game is initiated and conducted. The skill-based feature may include any of a wide variety of skill-based features, and may even comprise more than one. A short list of possible skill-based features 540 includes dexterity-based features (e.g., shooting games, twitch-type button or joystick games, skill-stop reaction games, hand-eye coordination physical or video games, etc.), memory-based features (e.g., "concentration"-type memory matching games, number/letter/light sequence memorization and recitation, etc.), strategy-based features (e.g., puzzle solving, Sudoku, Minesweeper, timed piece assembly, mathematical computation, visual comparisons, etc.), trivia (e.g., multiple choice questions, fill-in-the-blank, etc.), or any other gaming feature having an outcome that is directly affected by the input by the player. The skill-based feature may include any combination of gaming features, for example, a progression-based achievement bonus game, where the player continues from one game feature to another while remaining successful. Any suitable set of gaming features construed to determine a quantifiable skill-based rating (number of points, number of successes, achieved rank, achieved rating, etc.) may be used to make a set of available options available for player selection for customization of one or more gaming features.

In one embodiment, a skill-based feature is conducted to determine a configuration option having one or more parameters used to customize the play of one or more non-skill-based features of the wagering game. A configuration option having a set of configuration parameters 550 may be used to customize features of the wagering game and may include the combined use of payout (payline and/or symbol) multipliers and number of free games to manipulate game volatility (as previously discussed), the composition (removal, addition, and/or arrangement) of symbols on reels and/or wheels of the feature game, selection of various game options (including feature themes, genres, sound profiles, color schemes, background music, etc.), choices of the game(s) or features conducted during the non-skill-based portions of the wagering game, choice of a set of games to be randomly picked from), a specification of one or more time periods for prioritized or reserved play on a wagering game machine, the selection of enhanced wagering options (e.g., different denominations, number of paylines, maximum wagers, betting levels, side-bets, additional bets, etc.), the availability for playing an additional skill game for obtaining a modified configuration option, an option to replay the skill-based feature, activation of advanced hardware options (e.g., use of camera/microphone for input, voice/gesture commands for wager changing and game initiation, enabling hand-gestures, voice commands, button commands, etc.), etc.

In step 560, the player is prompted to select a configuration option from the configuration options available for player selection based upon the skill-based input (i.e., performance of the player) during the skill-based feature of the wagering game. In one embodiment, a player is prompted to select a single configuration option (comprising a group of various parameters). In other embodiments, a player may be permitted to select a configuration option having any number of constituent parameters. The player-selected configuration option is optionally confirmed by the player, recorded, and assigned for use in one or more subsequent features of the wagering game, such as a subsequent non-skill-based feature (FIGS. 6A-6B).

In step 570, a non-skill-based feature of the wagering game is conducted in accordance with the selected and determined customizing player-selected configuration option. The resulting customized non-skill-based feature is performed as part of the wagering game using the corresponding parameters of the configuration option, and a set of outcomes are generated accordingly as part of the wagering game outcome.

The non-skill-based features of the wagering game may include a wide variety of gaming options, including free spins of symbol-bearing reels, free spins of a wheel having credit indications thereon, the activation of a skill-based gaming feature (leading to the determination of one or more non-skill-based based customizing configuration parameter options), the conducting of one or more random-based gaming features, etc. Therefore, it is possible that a triggering event that occurs during the current bonus game may cause an additional bonus game to be conducted. As control of the process returns to step 520 to decide whether an event of this type has occurred, results of the bonus game (e.g., won credits, other modifying configuration parameters, etc.) are accrued and recorded for reconciliation when the wagering game concludes.

In step 580, upon conclusion of the base-game feature, bonus-game feature, or both, the results from the features conducted during the wagering game are accrued in their entirety as the wagering game prepares to conclude. This may include combining the outcomes all the conducted features into a single set of results.

In step 590, the wagering game outcome (comprising all the constituent feature components) is displayed to the player. This may be reflected by a "credits won" meter (e.g., meter 84, 125), a detailed summary screen, a celebratory animation sequence, or some other generated graphical and/or audio presentation. Upon conclusion of the wagering game, an appropriate transfer of the winnings, if any, is made to a corresponding credit balance. At this point, this concludes the wagering game instance. The wagering game machine may enter a welcome/attraction mode, making it possible for a player to initiate another wagering game instance, initiate a cashout operation, or modify settings of the wagering game machine (e.g., change current wagering game, change wager levels, number of payout lines, etc.).

In one embodiment, a wagering game may include a non-skill-based feature that implements a prize wheel having particular prizes thereon (e.g., credit amounts, physical or compensatory awards, etc.) where the skill-based feature involves collecting the prizes used to populate one or more prize wheels of varying volatility. The non-skill-based feature may randomly select one of the prize wheels to spin to award prizes to the player. Alternatively, a player may be prompted to select a single prize wheel from a plurality of available prize wheels. The prize wheels (and/or available segments thereon) may be partially or entirely based upon the player's skill during the skill-based feature. Thus, there is a determination of a player-selected configuration option comprising a set of configuration parameters (directly affected by the skill-based input of a player during a non-skill-based feature of the wagering game), where the configuration option is used to conduct the non-skill-based feature of the wagering game and adjust the corresponding outcome of the wagering game.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system, comprising:

a regulated gaming machine primarily dedicated to playing at least one casino wagering game, the casino wagering game having a skill-based feature and a non-skill-based feature, the gaming machine including an electronic display device and one or more electronic value input devices comprising at least one of a bill acceptor, a ticket acceptor, a card reader, or a coin acceptor; and game-logic circuitry configured to:

detect, via at least one of the one or more electronic value input devices, a physical item associated with a monetary value that establishes a credit balance;

initiate the casino wagering game in response to an initiation input indicative of a wager covered by the credit balance;

conduct the skill-based feature;

cause the electronic display device to display a score meter indicating a player's skill-based performance within the skill-based feature;

determine a plurality of player-selectable configuration options for the non-skill-based feature based at least partially upon the player's skill-based performance within the skill-based feature as indicated by the displayed score meter, each player-selectable configuration option of the plurality of player-selectable configuration options indicating: (i) a respective predetermined volatility of the non-skill-based feature, (ii) a composition of reels or wheels used in the non-skill-based feature, and (iii) a multiplier applied to any payouts in a series of free spins of symbol-bearing reels or wheels of the non-skill-based feature, the predetermined volatility of the non-skilled based feature is at least partially a function of the multiplier and an initial number of free spins in the series of free spins, wherein the respective initial number of free spins for the plurality of player-selectable configuration options varies inversely to the respective multiplier;

cause the electronic display device to display the plurality of player-selectable configuration options and any non-selectable configuration options, the non-selectable configuration options being visually distinguishable from the plurality of player-selectable configuration options;

conduct the non-skill-based feature according to a selected one of the plurality of player-selectable configuration options;

determine an outcome of the casino wagering game based, at least partially, on the non-skill-based feature;

display the outcome of the casino wagering game on the electronic display device, and adjust the credit balance in accordance with the outcome of the casino wagering game; and receive, via at least one of the one or more electronic input devices, a cashout input that initiates a payout from the credit balance.

2. The gaming system of claim 1, wherein responsive to input by the player, the player-selected configuration option is selected from the plurality of player-selectable configuration options displayed concurrently to the player via the electronic display device.

3. The gaming system of claim 1, wherein the plurality of player-selectable configuration options includes a greater number of options based upon the outcome of the skill-based game exhibiting a greater level of skill.

4. The gaming system of claim 1, wherein the plurality of player-selectable configuration options varies in number in accordance with a level of skill exhibited during the skill-based feature such that a greater level of skill yields a greater number of player-selectable configuration options in the plurality.

5. The gaming system of claim 1, wherein a greater number of the plurality of player-selectable configuration options is associated with a greater range of volatility choices for the non-skill-based feature.

6. The gaming system of claim 1, wherein each of the plurality of player-selectable configuration options define a constant return-to-player (RTP) payback percentage of the casino wagering game.

7. The gaming system of claim 1, wherein the player-selected configuration option specifies at least one of a theme of the non-skill-based feature, a choice of the non-skill-based feature, a reservation for gaming, betting options for the non-skill-based feature, a choice of feature-triggering criteria, or a choice of player-input device options.

8. A method of operating a gaming system, the gaming system including game-logic circuitry and a regulated gaming machine primarily dedicated to playing at least one casino wagering game, the casino wagering game having a skill-based feature and a non-skill-based feature, the gaming machine including an electronic display device and one or more electronic value input devices comprising at least one of a bill acceptor, a ticket acceptor, a card reader, or a coin acceptor, the method comprising:

detecting, via at least one of the one or more electronic value input devices, a physical item associated with a monetary value that establishes a credit balance;

initiating, via the game-logic circuitry, the skill-based feature of the casino wagering game in response to an input indicative of a wager covered by the credit balance;

conducting, via the game-logic circuitry, the skill-based feature;

displaying, via the electronic display device, a score meter indicating a player's skill-based performance within the skill-based feature;

determining, via the game-logic circuitry, a plurality of player-selectable configuration options for the non-skill-based feature of the casino wagering game based at least partially upon the player's skill-based performance within the skill-based feature as indicated by the displayed score meter, each player-selectable configuration option of the plurality of player-selectable configuration options indicating: (i) a respective predetermined volatility of the non-skill-based feature, (ii) a composition of reels or wheels used in the non-skill-based feature, and (iii) a multiplier applied to any payouts in a series of free spins of symbol-bearing reels or wheels of the non-skill-based feature, the predetermined volatility of the non-skilled based feature is at least partially a function of the multiplier and an initial number of free spins in the series of free spins, wherein the respective initial number of free spins for the plurality of player-selectable configuration options varies inversely to the respective multiplier;

displaying, by the electronic display, the plurality of player-selectable configuration options and any non-selectable configuration options, the non-selectable configuration options being visually distinguishable from the plurality of player-selectable configuration options;

detecting, via at least one of the one or more electronic input devices, a selection of one or more of the player-selectable configuration options presented on the electronic display device;

conducting, via the game-logic circuitry, the non-skill-based feature according to the selected configuration options;

determining, via the game-logic circuitry, an outcome of the casino wagering game based, at least partially, on the non-skill-based feature;

displaying the outcome of the casino wagering game on the electronic display device, and adjusting, via the game-logic circuitry, the credit balance in accordance with the outcome of the casino wagering game; and receiving, via the game-logic circuitry, a cashout input that initiates a payout according to the credit balance.

9. The method of claim 8, wherein the plurality of player-selectable configuration options varies in number in accordance with a level of skill exhibited by the skill-based input such that a greater level of skill yields a greater number of player-selectable configuration options.

10. The method of claim 8, wherein the plurality of player-selectable configuration options includes at least one of a theme of the non-skill-based feature, a choice of the non-skill-based feature, a reservation for gaming, betting options for the non-skill-based feature, a choice of feature-triggering criteria, or a choice of player-input device options.

11. The method of claim 8, wherein a greater number of the plurality of player-selectable configuration options is associated with a greater range of volatility choices of the non-skill-based feature.

12. A method of operating a gaming system, the gaming system including game-logic circuitry and a regulated gaming machine, the gaming machine primarily dedicated to playing at least one casino wagering game, the casino wagering game having a skill-based feature and a non-skill-based feature, the gaming machine including an electronic display device and one or more electronic value input devices comprising at least one of a bill acceptor, a ticket acceptor, a card reader, or a coin acceptor, the method comprising:

detecting, via at least one of the one or more electronic value input devices, a physical item associated with a monetary value that establishes a credit balance;

initiating, via the game-logic circuitry, the casino wagering game in response to an initiation input indicative of a wager covered by the credit balance;

conducting, via the game-logic circuitry, the skill-based feature;

displaying, via the electronic display device, a score meter indicating a player's skill-based performance within the skill-based feature;

determining, via the game-logic circuitry, a plurality of player-selectable configuration options for the non-skill-based feature based at least partially upon the player's skill-based performance within the skill-based feature as indicated by the displayed score meter, each player-selectable configuration option of the plurality of player-selectable configuration options indicating: (i) a respective predetermined volatility of the non-skill-based feature, (ii) a composition of reels or wheels used in the non-skill-based feature, and (iii) a multiplier applied to any payouts in a series of free spins of symbol-bearing reels or wheels of the non-skill-based feature, the predetermined volatility of the non-skilled based feature is at least partially a function of the multiplier and an initial number of free spins in the series of free spins, wherein the respective initial number of free spins for the plurality of player-selectable configuration options varies inversely to the respective multiplier;

displaying, by the electronic display, the plurality of player-selectable configuration options and any non-selectable configuration options, the non-selectable configuration options being visually distinguishable from the plurality of player-selectable configuration options;

conducting, via the game-logic circuitry, the non-skill-based feature according to a selected one of the plurality of player-selectable options;

determining, via the game-logic circuitry, an outcome of the casino wagering game based, at least partially, on an outcome of the non-skill-based feature;

displaying the outcome of the casino wagering game on the electronic display device, and adjusting, via the game-logic circuitry, the credit balance in accordance with the outcome of the casino wagering game; and receiving, via at least one of the one or more electronic input devices, a cashout input that initiates a payout from the credit balance.

13. The method of claim 12, wherein the player-selected configuration option specifies at least one of a theme of the non-skill-based feature, a choice of the non-skill-based feature, a reservation for gaming, betting options for the non-skill-based feature, a choice of feature-triggering criteria, or a choice of player-input device options.

14. The method of claim 12, wherein responsive to input by the player, the player-selected configuration option is selected from the plurality of player-selectable configuration options displayed concurrently to the player via the electronic display device, the plurality of player-selectable configuration options varying in number such that the plurality of player-selectable configuration options includes a greater number of options based upon the outcome of the skill-based game exhibiting a greater level of skill.

15. The method of claim 12, wherein the player-selected configuration option is selected directly in response to the skill-based outcome.

16. The method of claim 12, wherein a greater number of the plurality of player-selectable configuration options is associated with a greater range of volatility choices for the non-skill-based feature.

* * * * *